US012716634B2

(12) United States Patent
Bicalho et al.

(10) Patent No.: US 12,716,634 B2
(45) Date of Patent: Aug. 25, 2026

(54) METHOD FOR CONTROLLING REFRIGERATOR OPERATION AND REFRIGERATOR

(71) Applicant: ELECTROLUX DO BRASIL S.A., Curitiba (BR)

(72) Inventors: André Bicalho, Curitiba (BR); Marcelo Giesteira Campani, Curitiba (BR); Mario Bittencourt Vargas, Curitiba (BR); Felipe Rosa Ormelez, Curitiba (BR); Bruno Sergio Marghoti, Curitiba (BR)

(73) Assignee: Electrolux Do Brasil S.A., Curitiba (BR)

( * ) Notice: Subject to any disclaimer, the term of this patent is extended or adjusted under 35 U.S.C. 154(b) by 325 days.

(21) Appl. No.: 18/276,692

(22) PCT Filed: Feb. 16, 2022

(86) PCT No.: PCT/BR2022/050048
§ 371 (c)(1),
(2) Date: Aug. 10, 2023

(87) PCT Pub. No.: WO2022/174317
PCT Pub. Date: Aug. 25, 2022

(65) Prior Publication Data

US 2024/0133604 A1 Apr. 25, 2024
US 2024/0230192 A9 Jul. 11, 2024

(30) Foreign Application Priority Data

Feb. 17, 2021 (BR) ..... 10 2021 002902-1

(51) Int. Cl.
*F25B 49/02* (2006.01)

(52) U.S. Cl.
CPC ..... *F25B 49/022* (2013.01); *F25D 2700/02* (2013.01)

(58) Field of Classification Search
CPC ..... F25B 49/022; F25B 2700/02
See application file for complete search history.

(56) References Cited

U.S. PATENT DOCUMENTS 5,315,835 A * 5/1994 Park ..... F25D 21/006 62/155
5,483,804 A 1/1996 Ogawa et al.
(Continued)

FOREIGN PATENT DOCUMENTS

AU 2019420355 B2 7/2020
GB 2257267 1/1993
(Continued)

OTHER PUBLICATIONS

Joohee, Control Method of Refrigerator, Jun. 17, 2020, KR20200069723A), Whole Document (Year: 2020).*
(Continued)

*Primary Examiner* — Larry L Furdge
(74) *Attorney, Agent, or Firm* — Chrisman Gallo Tochtrop LLC

(57) ABSTRACT

A method for controlling the operation of a refrigerator includes: a cabinet defining a refrigeration and/or freezing area; an isolating door that opens and closes the refrigeration and/or freezing area of the cabinet; a door opening sensor; and a cooling system configured to modify the temperature of the refrigeration and/or freezing area. The method includes steps of: monitoring the opening and closing of the door by means of the door opening sensor during a determined period; generating a door opening probability distribution at the time monitored in the previous step; and maintaining or modifying the operation of the cooling
(Continued)

system according to the door opening probability distribution.

28 Claims, 18 Drawing Sheets

(56) References Cited

U.S. PATENT DOCUMENTS

| | | | | |
|---|---|---|---|---|
| 2013/0312439 | A1 | 11/2013 | Howell | |
| 2016/0238308 | A1* | 8/2016 | Uchida | F25D 17/065 |

FOREIGN PATENT DOCUMENTS

| | | | | |
|---|---|---|---|---|
| JP | S63254379 | | | 10/1988 |
| JP | 2012057886 | | | 3/2012 |
| KR | 20200069723 | A | * | 6/2020 |
| WO | 2012112057 | | | 8/2012 |
| WO | 2020144847 | A1 | | 7/2020 |

OTHER PUBLICATIONS

Kamisako et al., Refrigerator, Nov. 17, 2010, EP2251623A1, Whole Document (Year: 2010).*
International Search Report for PCT/BR2022/050048 dated Jun. 13, 2022, 3 pages.

* cited by examiner

METHOD FOR CONTROLLING REFRIGERATOR OPERATION AND REFRIGERATOR

FIELD OF THE INVENTION

The present invention relates to a method for detecting door opening pattern and detecting thermal load insertion in a door opening for controlling the operation of a refrigerator. The method can be applied to refrigerators that have controllers for controlling refrigeration operation of a refrigerator, comprising an adequate processing of parallel events that are able to influence the control result.

BACKGROUND OF THE INVENTION

In domestic refrigerators, despite the operating set point chosen in a user interface, current control algorithms do not consider consumer habits and preferences efficiently. Daily routine also has a big influence on product performance, especially taking into account temperature consistency over time, which will have an impact on food preservation.

In addition, current control algorithms do not take into account whether it is night or day, always applying the same logic to determine the desired compressor and fan speeds to reach a desired temperature. That is, the audible sound pressure of the refrigerator operation detected by the consumer is the same when the hours of activity of the day and the hours of rest of the day are compared.

The isolated application of light sensors to determine night time is known in the prior art, but the person skilled in the art also knows that normally people can have different sleep schedules and, therefore, have an algorithm that identifies the consumer behavior before measuring incident light, will suit the operation to different sleep schedules.

One of the existing solutions is found in document US 2015/0226475 A1, which describes a refrigerator and a control method capable of controlling, in isolation, a temperature in a storage compartment for the next 24 hours based on the standard of recent use of the refrigerator by a user.

Another solution can be found in U.S. Pat. No. 6,739,146 B1, which discloses a control method that determines the ideal interval between successive refrigerator defrost or defrost cycle events, as well as the duration of each defrost cycle, based on in cycles already completed.

In this document, the controller stores in memory information regarding the duration time and interval between each previous defrost. If the previous cycle is less than a predetermined period, indicating that the ice build-up was minimal, the controller will allow a longer interval between successive activations of the defrost system. In this way, the controller can optimize the defrosting operation of the refrigerator so that the food inside the system is not subject to constant temperature variations.

Yet another development is disclosed in EP 1 710 522 B1, involving an apparatus for deep freezing of food products containing water, adapted to indicate in advance the time required for, at a defined location and on or within a given food product—as detected by an appropriate temperature sensor—a certain temperature reaching a predetermined value below freezing temperature, as well as the time when that temperature will be reached.

This document reveals applying a plurality of successive measurements and associated processing steps, using a defined number of measurement instants and corresponding previous measurement intervals, programmed in a neural network together with the respective algorithms.

Thus, a person skilled in the art will appreciate that current control algorithms that aim to maintain a stable temperature set point or apply different operating modes to the refrigerator do not adequately consider user interaction with the product. This means, for example, that the control algorithms alone change the speed of the compressor and fan to achieve the temperature control result.

In view of the above, it is clear that the state of the art still lacks efficient technical solutions aiming at a control method with an adequate processing of parallel events that are able to influence the result of refrigeration operation control of a refrigerator.

DESCRIPTION OF THE INVENTION

From this scenario that the present invention arises, a method for controlling a refrigerator operation considering parallel events, which are able to influence the control result efficiently and adequately with regard to the noise level of the refrigerator, refrigerator defrost, refrigerator temperature stability, refrigerator fast cooling, refrigerator ease of use.

Still, the invention appears to provide a lower temperature fluctuation, a lower energy consumption due to less temperature fluctuation and a lower energy consumption due to the proper activation of a vacation mode in case the refrigerator is not used by a long time.

Also, the present invention aims to improve the freshness of stored foods due to less temperature fluctuations and reduce food waste, among others that will be clearly apparent to a person skilled in the art related to the scope of the present invention.

One or more objectives of the present invention mentioned above, among others, is (are) achieved by means of a method for controlling refrigerator operation, comprising a cabinet that determines a refrigeration and/or freezing area; an isolating door that opens and closes the cabinet's refrigeration and/or freezing area; a door opening sensor; and a cooling system configured to modify the temperature of the refrigeration and/or freezing area.

According to the invention, the method comprises the steps of:

- monitor the opening and closing of the door by means of the door opening sensor during a determined period;
- generating a door opening probability distribution in the time monitored in the previous step; and
- maintain or modify the operation of the cooling system according to a door opening probability distribution.

Additionally, the method comprises the steps of:

- counting a number of doors opening in the period of 1 hour in a door opening counter for each hour of a day;
- continuously storing a number of doors opening counted throughout the day in a local vector with relative positions respectively for each period of 1 hour of the day;
- continuously count and store moving average numbers of door opening events in a global vector with relative positions respectively to each period of 1 hour of the days; and
- generating a door opening probability distribution vector corresponding to the moving average numbers of door opening events of the global vector with relative positions respectively to each period of 1 hour of the days.

In one embodiment, the method comprises the steps of:

monitor an internal temperature sensor of the refrigerator and reading a value corresponding to the internal temperature measured;

calculate an exponentially weighted average of smoothed temperature;

calculate a current temperature difference between the measured internal temperature and the calculated exponentially weighted average of smoothed temperature; and determining a value relative to a heat exchange rate inside a refrigerator cabinet;

account for a single door opening; and with each calculation of the current temperature difference, determine and update a maximum value of current temperature difference among the calculated temperature difference values over time after the opening of the door; and calculate an average of temperature derivative against the calculated temperature derivative values over time after the opening of the door.

With that, in one embodiment, the method comprises the steps of:

apply a support vector machine technique to the maximum values of the current temperature difference and the average of temperature derivative; and for a support vector machine result greater than or equal to zero, determining an occurrence of a thermal load insertion in the refrigerator in a door opening;

during the occurrence of a thermal load insertion of the refrigerator into a door opening, configuring the cooling system to operate at a higher cooling rate compared to a cooling rate of a period prior to the opening of the door.

Also, one or more objectives of the present invention mentioned above, among others, is (are) achieved by means of a refrigerator, comprising: a cabinet that determines a refrigeration and/or freezing area; an isolating door that opens and closes the cabinet's refrigeration and/or freezing area; a door opening sensor; and a cooling system configured to modify the temperature of the refrigeration and/or freezing area; and at least one controller configured to act on the cooling system; the controller being configured to perform a refrigerator control method.

Still, the refrigerator comprises the cooling system with a heating element configured to defrost the refrigerator; an operating mode activation element; an internal temperature sensor of the refrigerator storage cabinet, an external ambient temperature sensor of the refrigerator; and the controller configured to receive readings from the sensors and the operating mode activation element and configured to act at least on the cooling system and/or heating element.

BRIEF DESCRIPTION OF THE DRAWINGS

Other embodiments, systems, methods, features and aspects will be evident from the following description taken in conjunction with the following drawings.

DESCRIPTION OF EMBODIMENTS OF THE INVENTION

Other objects, technical effects and advantages of the present invention will be apparent to those skilled in the art from the following detailed description which makes reference to the attached figures, which illustrate non-exhaustive embodiments of the claimed objects.

Initially, it should be noted that the method and refrigerator of the present invention will be described below according to particular, but not limiting, embodiments, since its implementation can be carried out in different ways and according to the application desired by the person skilled in the art.

Figure 1:
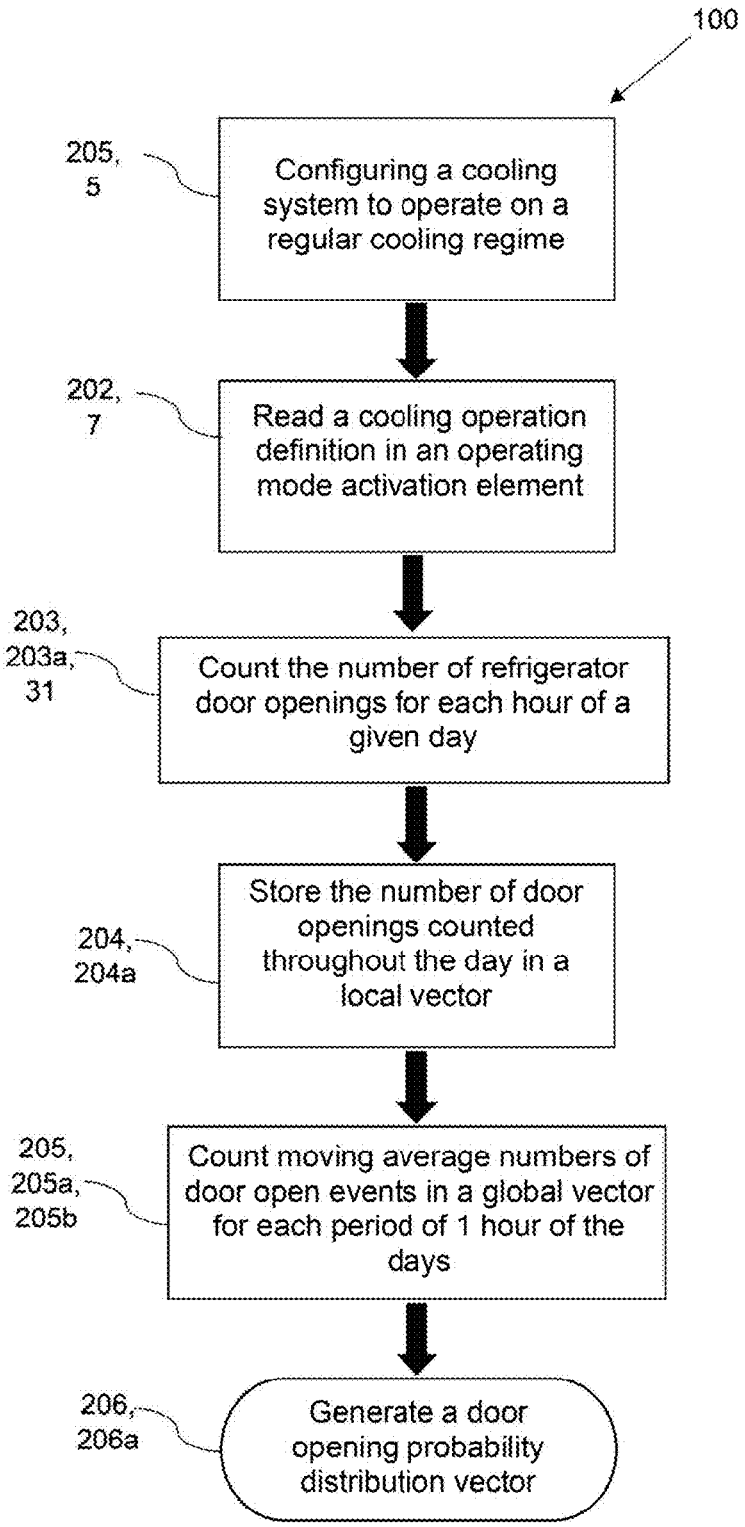
FIG. 1 illustrates an embodiment of the method of the present invention with a door opening probability distribution vector for detecting the door opening pattern of a refrigerator.
Figure 13:
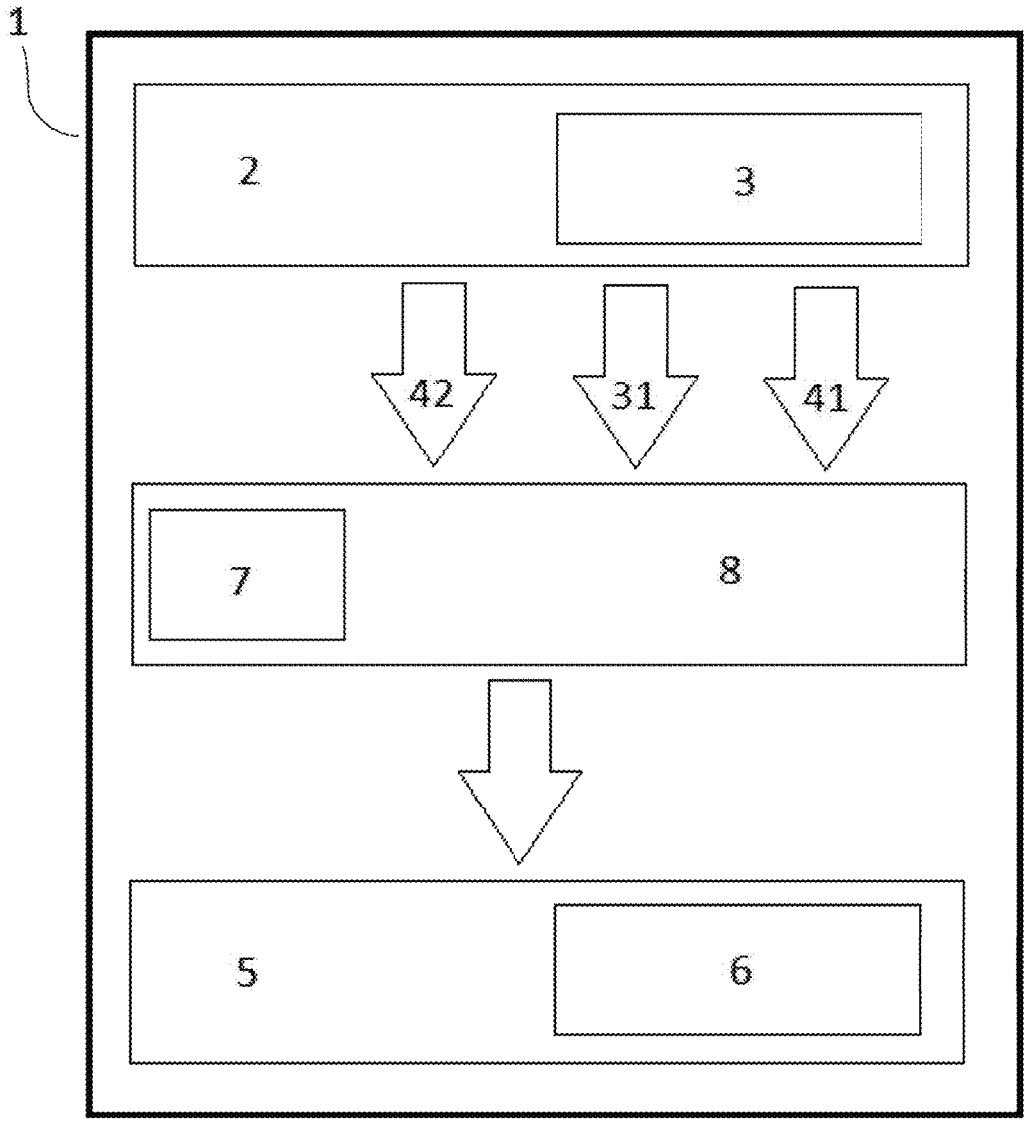
FIG. 13 is a schematic diagram that describes the operational relationships that exist between the components of a refrigerator of the present invention.

As can be seen from FIG. 1 and complemented by the illustration in FIG. 13, the present invention comprises a cabinet 2 that determines a cooling and/or freezing area; an isolating door 3 that opens and closes the refrigeration and/or freezing area of cabinet 2; a door opening sensor 31;

and a cooling system 5 configured so as to modify the temperature of the refrigeration and/or freezing area.

A block diagram representation for controlling the operation of a refrigerator 1 of the present invention provides a method 100, which comprises creating a probability distribution, with a periodic, hourly sampling, containing a number of doors opening events of refrigerator in a single sampling day.

In a first embodiment, the method 100 of the invention comprises: configuring 201 a cooling system 5 to operate in a regular cooling regime, generally when the refrigerator is connected to the electricity network. Furthermore, the refrigerator 1 is configured to reading 202 a definition of refrigeration operation in an operating mode activation element 7 of the refrigerator.

Therewith, the method 100 comprises monitoring a refrigerator door opening sensor 31 and counting 203 a number of doors opening in the period of 1 hour in a door opening counter 203*a* for each hour of a given day; in addition to continuously storing 204 a number of doors opening counted throughout the day in a local vector 204*a* with 24 positions relative to each period of 1 hour of the sampling day respectively.

Additionally, in one embodiment the method 100 of the invention comprises continuously counting and storing 205 moving average numbers of door opening events in a global vector 205*a* with 24 positions relative to each period of 1 hour of the sampling days respectively; and generating 206 a door opening probability distribution vector 206*a* corresponding to the moving average numbers of door opening events of the global vector 205*a* with 24 positions relative to each period of 1 hour of the sampling days respectively.

Thus, in an embodiment of the method of the present invention, the result of accounting 205 of the moving average of door opening events in a global vector 205*a*, from a smoothing factor 205*b*, comprises an exponentially weighted average, defined by the equation:

$$\text{Global vector}(205a) = \text{Smoothing factor}(205b) \times \text{Global vector}(205a) + (1 - \text{Smoothing factor}(205b) \times \text{Local vector}(204a).$$

Thus, in one embodiment, the smoothing factor 205*b* varies between 0 and 1 by modifying the weight of the local vector (204*a*) to determine the global vector (205*a*) according to the relevance and/or importance given to the local vector (204*a*), preferably being around 0.4. Obviously, the local vector values can influence more or less the global value, and the greater its influence, the more the system will be subject to detect sporadic variations, while the smaller its influence, the greater its resistance to such noises.

In some embodiments of the present invention, the method 100 provides a step to calculate a moving average referring to the average of doors opening during the previous n days, with the following equation:

$$G_n[i] = (L[i] + G_{(n-1)}[i])/n.$$

In this case, $G_n$ [i] is the global vector 205*a* on day n that corresponds to the moving average of doors opening of a period i of 1 hour; and L [i] is the local vector 204*a* which corresponds to the number of doors opening in a period of 1 hour of the day.

According to some embodiments of the present invention, as will be better elucidated, the method 100 provides a step of maintaining or modifying the operation of the cooling system 5 according to the probability distribution of door opening 206*a*. Thus, method 100 will define a weighted average to create a curve of probability of use of refrigerator 1, that is, probability of access at a given time of day to the interior of refrigerator 1 through doors opening. This curve is used for method 100 to define when it is most appropriate, for example, to perform a defrost in the refrigerator based on the usual operation of refrigerator 1. Preferably, such defrost should be performed in a period of lesser use of the refrigerator, usually determined as "night time".

Also, according to some embodiments, through the usage probability curve, method 100 will start a vacation mode if the door is closed longer than expected in the definition of cooling operation. Other ways of maintaining or modifying the operation of the cooling system 5 will be apparent from the other embodiments of the present invention, or even can be seen in the cited references.

Figure 2:
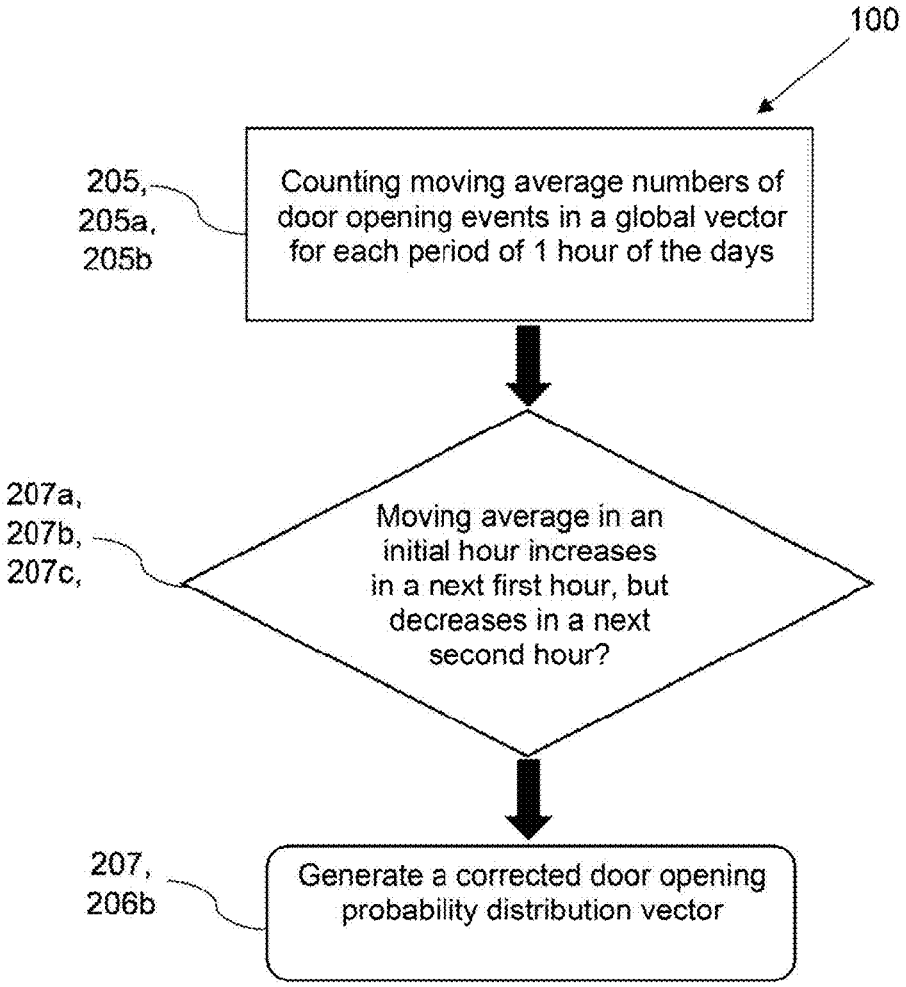
FIGS. 2 and 2*a* illustrate an embodiment of the method of the present invention with a corrected door opening probability distribution vector for detecting the door opening pattern of a refrigerator.
Figure 2B:
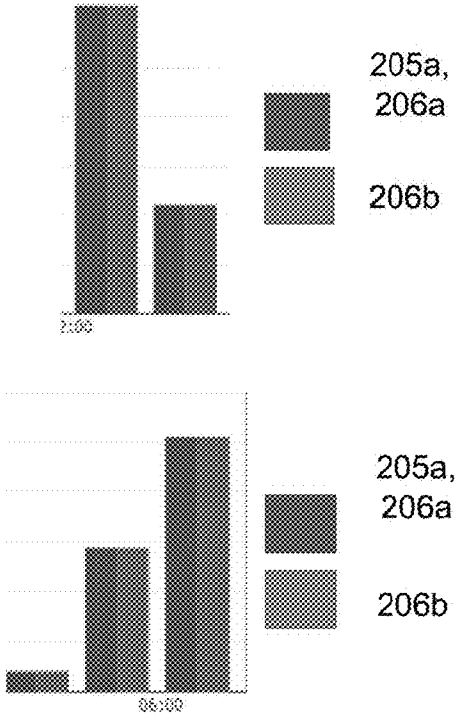
FIG. 2*b* illustrates two examples of uncorrected door opening probability distribution vectors.
Figure 2A:
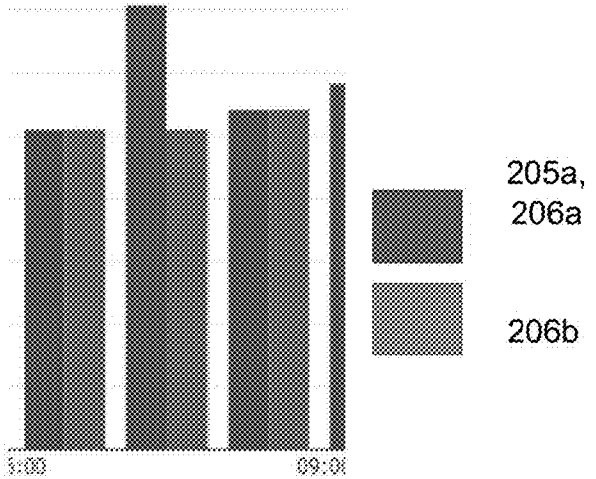

With reference to FIGS. 2, 2*a* and 2*b*, in an embodiment of the method of the present invention a correction filter is performed to remove the numbers corresponding to sporadic uses of the refrigerator, that is, sudden variations in the moving average numbers of global vector 205*a* door opening events, and thus the method increases the probability of defining longer night periods, wherein the application definition of which will be elucidated in the description of the present invention.

As for the correction, additionally, when the moving average number and probability of a door opening stored in the global vector 205*a* at a given start time 207*a* increases in a next first hour 207*b*, but decreases in an adjacent next second hour 207*c*, the method provides the step of generating 207 a corrected door opening probability distribution vector 206*b*, by substituting the moving average number and door opening probability for the first hour 207*b* as constant and equal to the moving average and door opening probability of the given start time 207*a*.

In the embodiment illustrated in FIG. 2*a*, from the first set to the second set there is an increase in the moving average number of a door opening in the global vector 205*a* and, from the second set to the third set there is an adjacent drop of the same. Therefore, the correction filter described above acts to set a stable probability on a corrected door opening probability distribution vector 206*b*.

In addition, in the embodiment illustrated in FIG. 2*b*, from the first set to the second set and/or also to the third set there is a constant in the decrease or increase of the mean or probability. Therefore, method 100 does not perform a correction filter and a number equal to the door opening probability distribution vector 206*a* is kept.

Figure 3:
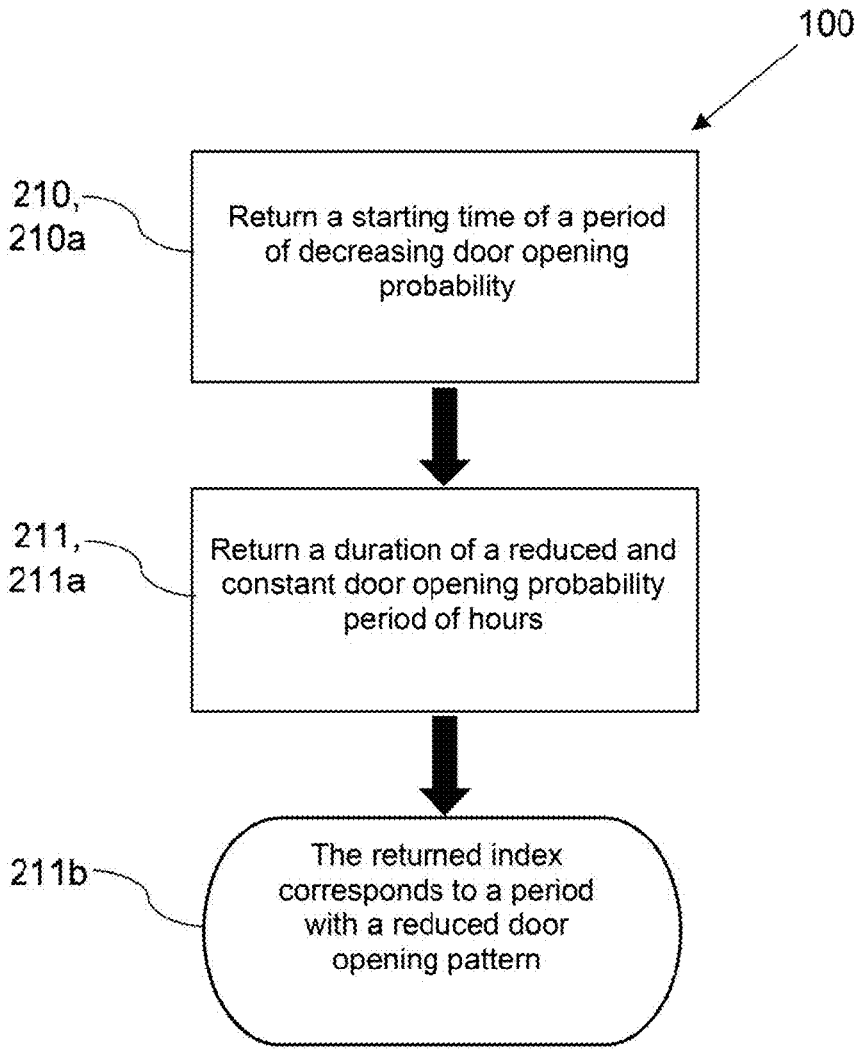
FIGS. 3 and 3*a* show an embodiment for detecting a period with a reduced door opening pattern of the present invention.
Figure 3A:
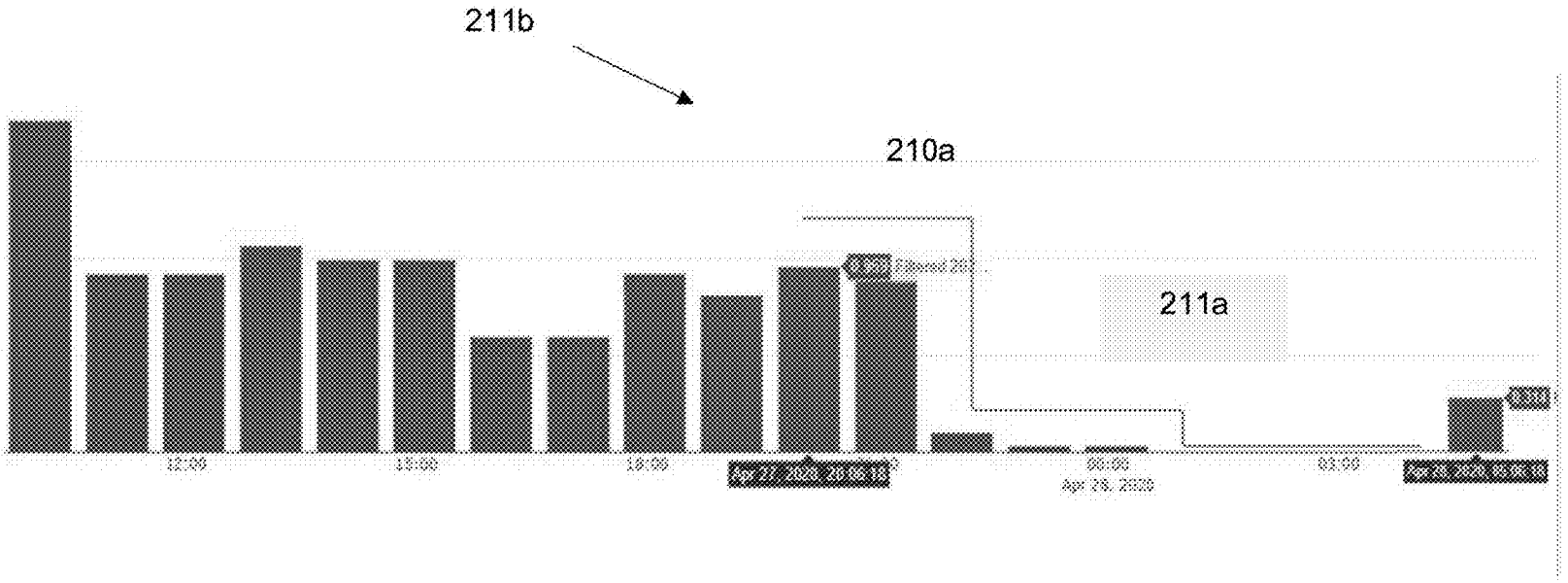

With reference to the mentioned probability of defining night periods in the operation of the refrigerator, and with reference to the illustration of FIGS. 3 and 3*a*, the invention defines the longest period of the day when the probability of having an open door event is decreasing and/or constant, by means of an embodiment of method 100 which provides a step of returning 210, continuously, in an index, a start time of a decreasing door opening probability period and store in a reduced door opening probability pattern start vector 210*a* with a certain number of positions, relative to each start time of the decreasing door opening probability of each among a certain number of sampling days; and returning 211, in the index, a duration of a constant and reduced door opening probability period of hours in a reduced door opening probability pattern period duration vector 211 a corresponding to each start time of the decreasing door opening probability period for each of the sampling days.

Concerning the definition of night periods in refrigerator operation, said returned index corresponds to at least one region 210*a*, 211 *a* in door opening probability distribution vector 206*a*, 206*b* that defines a period with a reduced door opening pattern 211 b.

Figure 4:
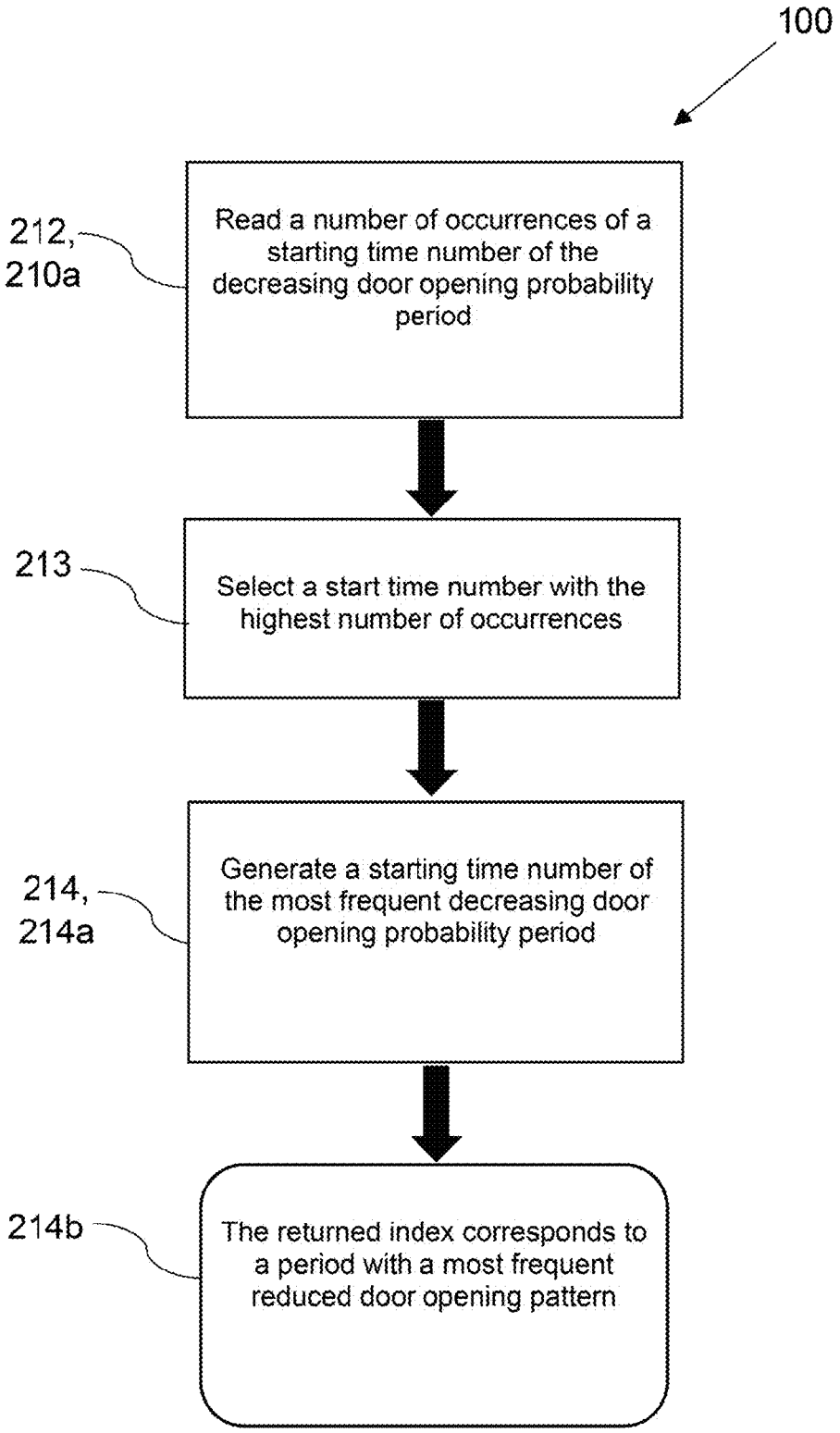
FIG. 4 illustrates an embodiment of the present invention for detecting a region in the vector corresponding to a period with a most frequent reduced door opening pattern for selection and application of a night period.

Furthermore, also with reference to the definition of night periods in the operation of the refrigerator, in an embodiment as illustrated in FIG. 4, the method 100 additionally comprises the steps of reading 212 a number of occurrences of a certain number of initial hours of the decreasing door opening probability period, at the positions of the reduced door opening probability pattern start vector 210*a* of each of the sampling days; selecting 213 a starting time number of the decreasing door opening probability period with the highest number of occurrences; and generating 214 a start time number of the most frequent decreasing door opening probability period 214*a* over the sampling days, corresponding to the start time number of the decreasing door opening probability period with the highest number of occurrences.

In this case, the returned index is a corrected index corresponding to a period with a most frequent reduced door opening pattern 214*b*.

Illustrating an embodiment of the present invention, according to method 100, the reduced door opening probability pattern start vector 210*a*, 214*a* comprises 14 positions, relative to each starting time of the decreasing door opening probability of each of 14 sampling days.

Therefore, in this embodiment, only from the 7th day of sampling, the first position of this vector is filled with the results of the reduced door opening probability pattern start vector 210*a*, 214*a*. After the 21st day, with 7 days to begin and added to 14 to fill the entire vector, method 100 selects from the vector index the number of hours of the day relative to the most frequent occurrences.

In one embodiment, the results after 21 days are: number of time of day 07: 9 occurrences; number of time of day 08: 1 occurrence; number of time of day 09: 1 occurrence; number of time of day 06: 1 occurrence; number of time of day 10: 2 occurrences. Thus, the most frequent number of time of day of this vector is the number 07, which contains 9 occurrences. This means that the night period must start after the seventh hour, which is relative to the period start time number of the most frequent decreasing door opening probability 214*a*, and the duration will follow the same duration obtained from the period duration vector of reduced door opening probability pattern 211 a.

In a preferred configuration, a new step can be added to the method, in order to limit the duration of the night period to avoid temperature instabilities in the product due to long working hours in special mode. This function receives as input the beginning of the night period and its maximum duration. If the duration is less than a predetermined maximum, no modification should be made to the returned values, otherwise the algorithm may prioritize the end or start times of the night duration. For example, if the previous result of the night time duration is thirteen hours, with the maximum night time duration being predetermined for the eight-hour refrigerator, the algorithm would add five hours to the result of the beginning of the night period or subtract five hours from the duration of the night period, to modify the operating regime and thus maintain the night mode in just eight hours. Preferably, the addition of five hours to the result is used, thus limiting the possible noise at early times of the night period, which can be problematic for the user. This means that the end of the discussed period will be kept the same (early morning) and the index that will be used as the beginning of the night will be the previous eight hours. Obviously, such maximum values vary according to refrigerator configurations, such as compressor power, internal air flow, size and heat exchange and loss capacity, among others, and there may still be the possibility of modifying it based on some control input from the user himself.

Thus, the method of the present invention may comprise a predetermined maximum duration for the duration of the reduced door opening probability period of hours, in which case the duration of the reduced door opening probability period of hours is greater than the predetermined maximum duration, the method further comprises the steps of: determining a period adjustment value by subtracting the maximum duration from the duration of the reduced door opening probability period of hours; and add the period adjustment value to the start time of the door opening probability period or subtract the maximum duration period adjustment value from the duration of the reduced door opening probability period of hours.

Figure 5:
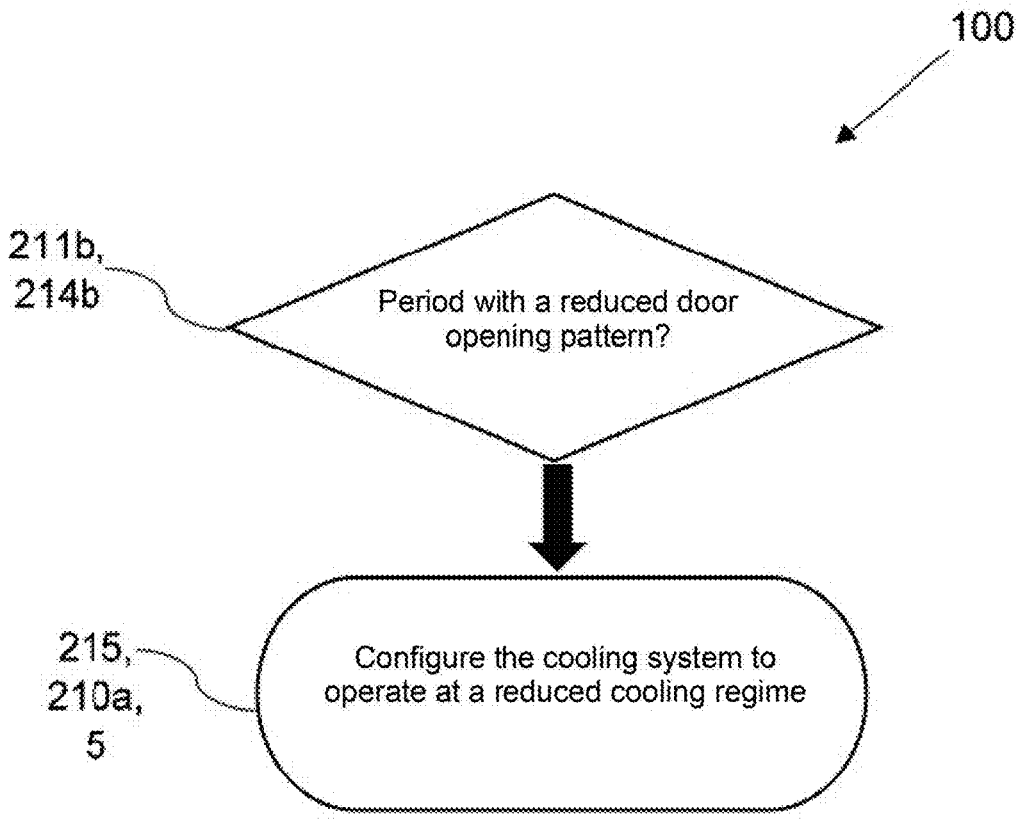
FIG. 5 shows an application of operating mode in a compressor, according to a period with reduced door opening pattern of the present invention.

In refrigerators that use a variable speed compressor and/or variable speed air circulation fans, it is generally desirable to apply different control parameters in order to prioritize noise reduction. In view of this and with reference to FIG. 5, in some embodiments of the present invention, the method 100 provides, during the period with a reduced door opening pattern 211*b* or reduced more frequent 214*b*, to configuring 215 the cooling system 5 to operate in a reduced cooling regime in relation to a regular cooling regime of a regular doors opening period.

Figure 6:
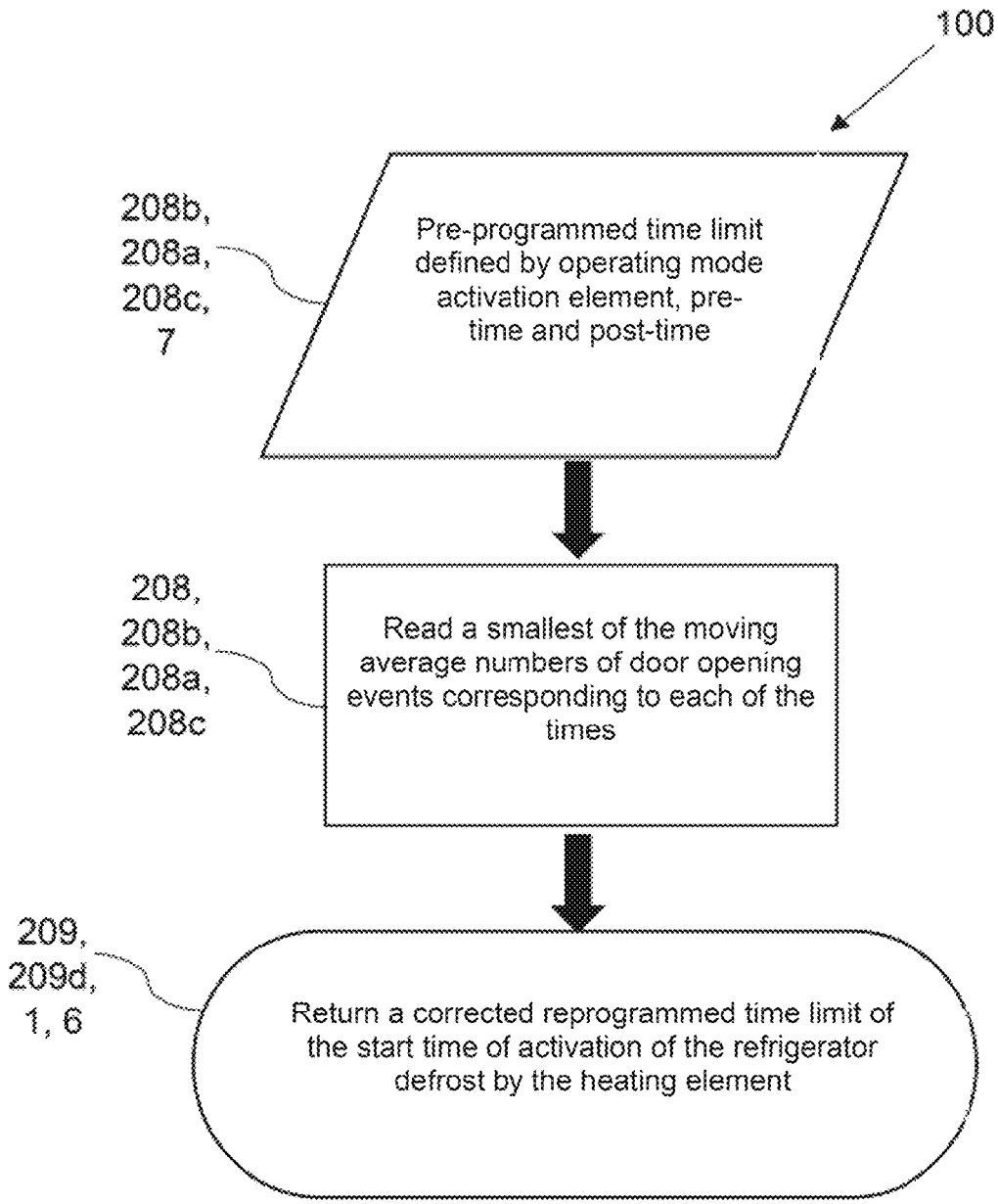
FIG. 6 shows an embodiment of a corrected time of the start time of activating the defrost of the refrigerator of the present invention.

Again, with reference to FIG. 6 and with respect to method 100 to define when it is most suitable, for example, to perform a defrost in the refrigerator based on the usual operation of the refrigerator 1 as described, in one embodiment of the present invention the method 100 comprises setting a value of a pre-programmed time limit 208*b* defined by the operating mode activation element 7 for a defrost of the refrigerator 1 by a heating element 6; and setting a value of a time earlier 208*a* than the pre-programmed time limit and a value of time later 208*c* than the pre-programmed time limit.

In view of this, method 100 comprises the additional steps of reading 208 a smallest among the moving average numbers of door opening events corresponding to each of the time prior to 208*a* to the pre-programmed time limit, the pre-programmed time limit 208*b* and the time after 208*c* to the pre-programmed time limit stored in the door opening probability distribution vector 206*a*, 206*b* corresponding to the moving average numbers of door opening events of the 24 position global vector 205*a*, relative to each period of 1 hour of the days.

Additionally, method 100 comprises returning 209 a corrected reprogrammed time limit 209*d* from the start time of refrigerator 1 defrost by heating element 6, defined by one of the times prior 208*a* to the pre-programmed time limit, the pre-programmed time limit 208*b* and the time after 208*c* the pre-programmed time limit, which comprises the smallest of the moving average numbers of door opening events, and trigger the defrost of refrigerator 1 by heating element 6 according to the corrected reprogrammed time limit 209*d*.

Generally, every refrigerator with no-frost technology, also known as frost-free or auto-defrost, executes a defrost routine that obeys certain conditions and timers.

In this embodiment, for example, after the seventh day (n>=7) the method 100 will use the global vector 205*a*, which contains the average of doors opening to define when to execute the defrost routine, that is, if regularly or define whether at the time of the regular pre-programmed defrost event, the defrost time will be changed to achieve the best efficiency according to the use of the refrigerator.

For example, in one embodiment the defrost is configured to run at the time of the current pre-programmed regular defrost event wherein the time index is equal to 4 (i=4). The method 100 uses the corresponding values in the global vector (205*a*) G[i] in the 3 values adjacent to said index of the moment of the current defrost predefined regular event (i=3, i=4 and i=5). In this embodiment, according to the method 100, the defrost must be performed at the index in which G[i] has the smallest value corresponding to door opening events. Thus, the recorded values are G[i=3]=4, G[i=4]=7, G[i=5]=3, and then method 100 of the present invention provides to run the defrost routine at hour 5, rather than hour 4. This reduces the likelihood of doors opening occurring while the system is performing a defrost routine.

In accordance with yet another embodiment of the present invention, as already mentioned, method 100 may also initiate a vacation mode if the door is closed longer than expected in the refrigeration operation setting.

Vacation mode detection comprises additional steps to assess whether the door has not been opened during a fixed inactivity assessment time parameter. Thus, if the door is not opened after all this time, the refrigerator must change its operating set point value or set point to maximum temperature. For example: if the time parameter is 3 days and there is no door opening detected after 3 days of operation, the refrigerator should change the operational set point value as high as possible for that specific refrigerator. In any case, when a door opening event is detected, the refrigerator should return to the normal factory configuration or according to the user's preference.

Figure 7:
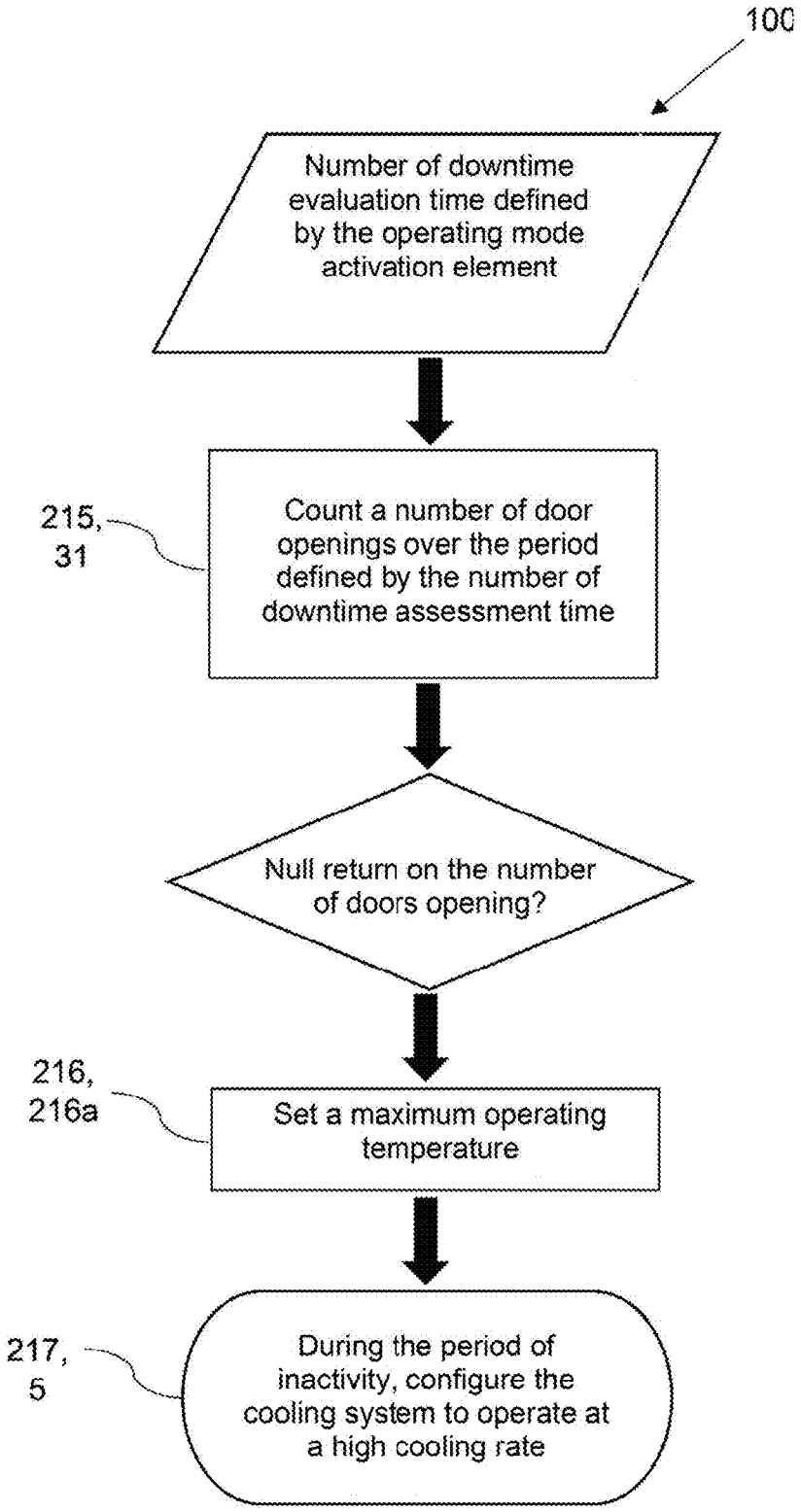
FIG. 7 shows an embodiment of a vacation mode of the refrigerator of the present invention.

In this embodiment illustrated in FIG. 7, the invention comprises the method 100, from an downtime evaluation time number defined by the operating mode activation element 7, monitoring the door opening sensor 31 and accounting 215 a number of doors opening over the period defined by the downtime evaluation time number in door opening counter 203*a*; and for a null returning on the number of door openings over the period defined by the downtime evaluation time number of the door opening counter 203*a* that defines a period of inactivity, setting 216 a default operating temperature for a maximum temperature of operation 216*a* during the period of inactivity.

The standard operating temperature for a maximum operating temperature 216*a*, although variable according to the characteristics of the refrigerators, can be set between 4° C. and 10° C. Further, the standard operating temperature for a maximum operating temperature 216*a* can preferably be set at 7° C., for example.

More specifically, also with reference to FIG. 7, the method 100 comprises in one embodiment during the period of inactivity, configuring 217 the cooling system 5 to operate at a reduced cooling regime in relation to a regular cooling regime a regular doors opening period.

Figure 8:
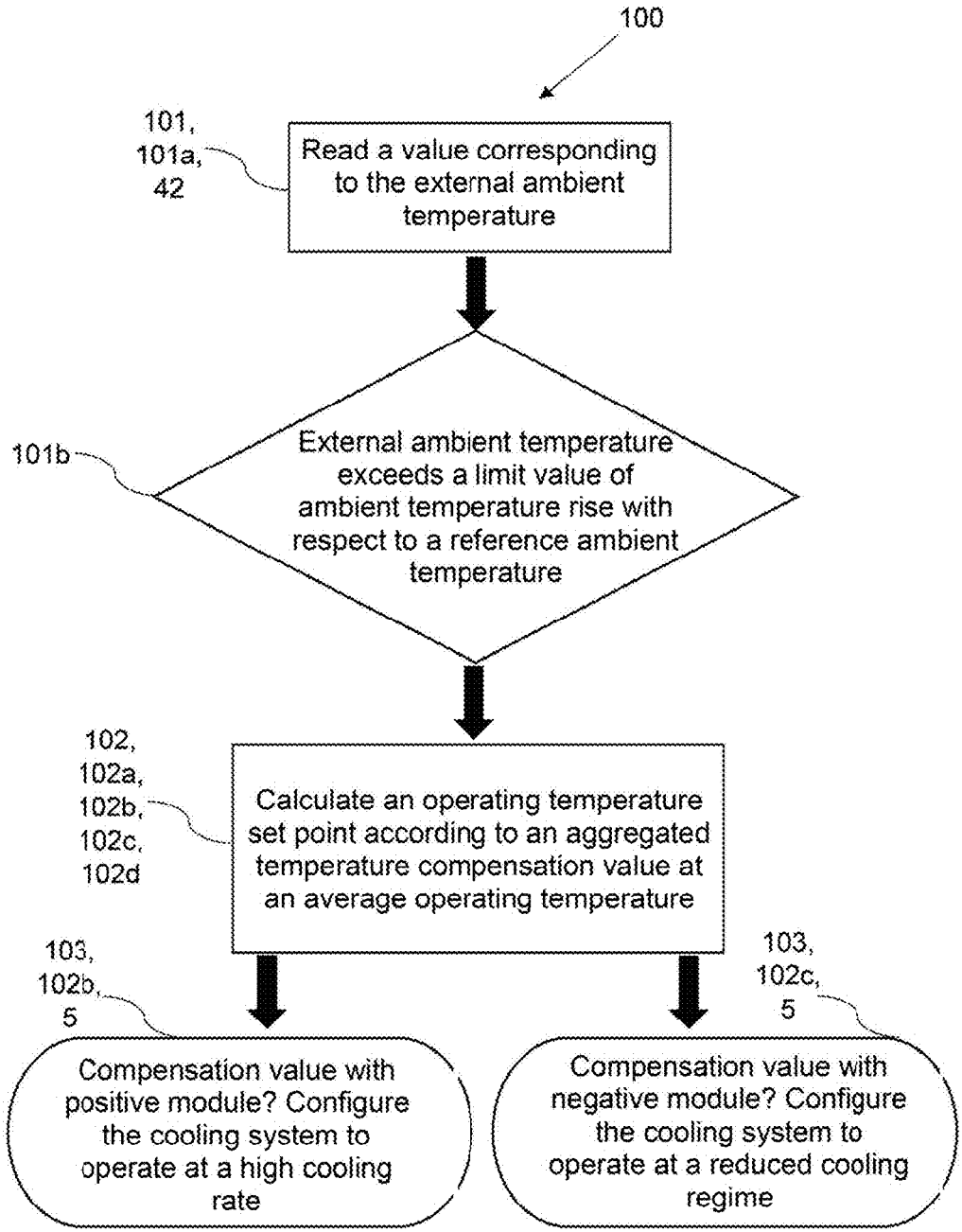
FIG. 8 illustrates an application of operating mode in a refrigerator, according to a difference between the internal temperature and the external environment of the refrigerator of the present invention.
Figure 9:
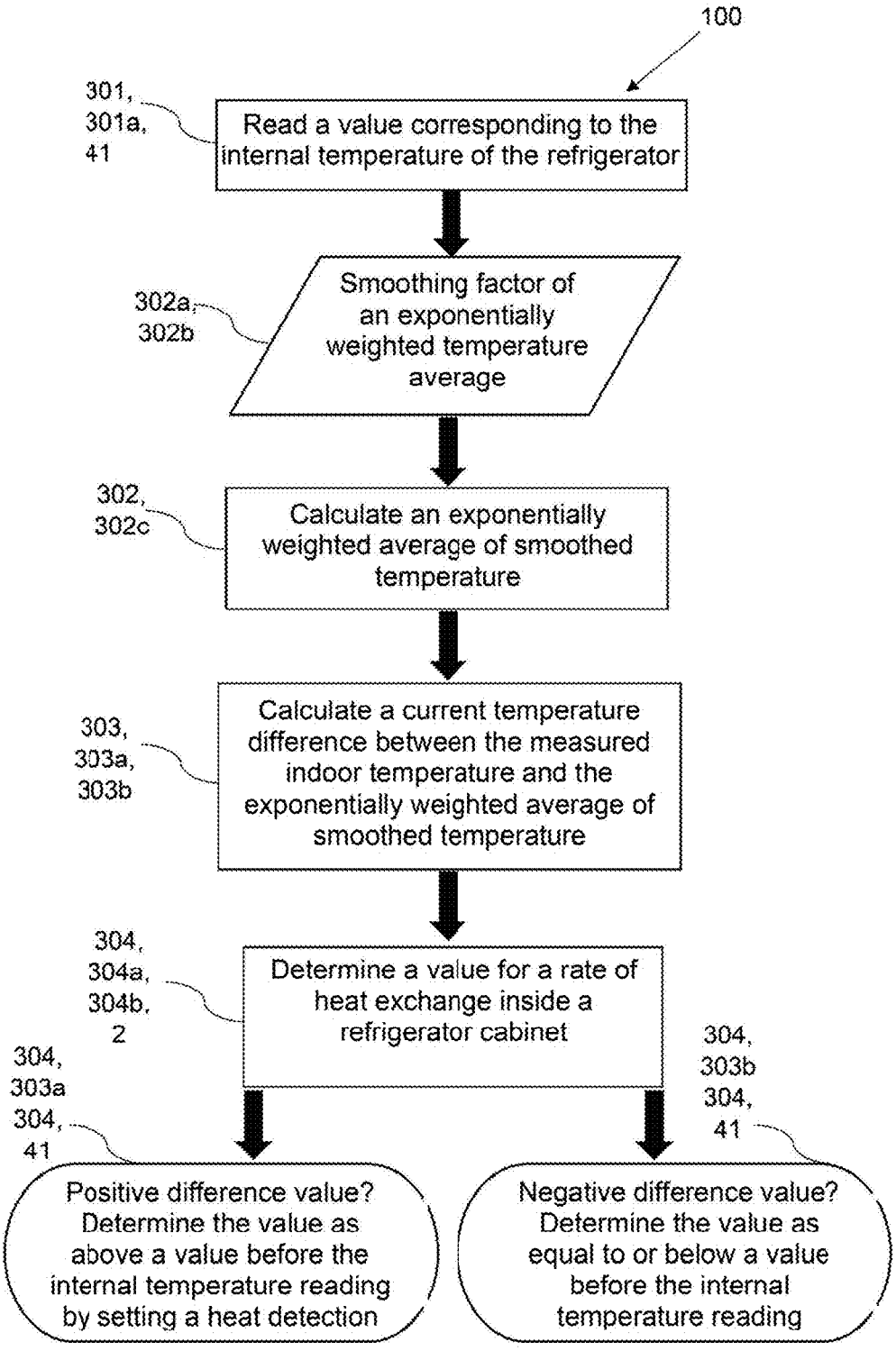
FIG. 9 is an illustration of an embodiment for setting the rate of heat exchange inside the cabinet for detecting thermal load in the refrigerator of the invention.

Another embodiment, in accordance with method 100 of the present invention, provides steps to automatically control the temperature set point of the refrigerator based on the difference in temperature inside and outside the refrigerator, measured by sensors. As shown in FIG. 8, for this embodiment the method 100 comprises the steps of: monitoring an external ambient temperature sensor 42 of the refrigerator 1 and reading 101 a value corresponding to the measured external ambient temperature 101*a*.

Thus, for an external ambient temperature value 101 a as it exceeds an ambient temperature limit value rise 101*b* with respect to a reference ambient temperature of 25° C., the method provides for calculating and storing 102 a set point operating temperature 102*a* according to a temperature compensation value 102*b*, 102*c* aggregated to a standard operating temperature defined by an average operating temperature 102*d*.

According to that embodiment, an embodiment may comprise the ambient temperature limit value 101*b* being set between 1° C. and 10° C. with respect to a reference ambient temperature of 25° C., the temperature compensation value 102*b*, 102*c* is set between 0.1° C. and 1° C., and the default operating temperature is set by an average operating temperature 102*d* set between −4° C. and 10° C.

According to this embodiment, another embodiment may comprise the ambient temperature limit value 101*b* being preferably set at 5° C. with respect to a reference ambient temperature of 25° C., the temperature compensation value 102*b*, 102*c* preferably be set at 0.5° C., and the standard operating temperature is set by an average operating temperature 102*d* preferably set at 3° C.

For these embodiments, as also shown in FIG. 8, the method 100 of the present invention may additionally comprise, for a temperature compensation value 102*b* with positive module, configuring 103 the cooling system 5 to operate in a regime of high cooling in relation to a cooling regime of a period prior to the reading of the external ambient temperature sensor 42 of the refrigerator 1.

Still, for these embodiments, the method 100 of the present invention may additionally comprise, for a temperature compensation value 102*c* with negative module, configuring 103 the cooling system 5 to operate in a reduced cooling regime with respect to a cooling regime of a period prior to the reading of the external ambient temperature sensor 42 of the refrigerator 1.

In an additional configuration, the control can automatically select the optimal refrigerator set point temperature based on ambient temperature and refrigerator heat exchange values. In this case, a linear interpolation function can be used, wherein two different inputs will determine the refrigerator offset: a) a vector containing the ambient temperature that the laboratory did the cycling test to calculate the average temperature of fresh food; and b) a vector containing the offset that must be applied to the set point based on the ambient temperature to obtain the ideal average, between 1° C. and 7° C., preferably 3° C., in the compartment.

In addition, the control can still keep the fan running for an additional fixed period after the compressor is turned off, thus returning part of the moisture from the evaporator to the refrigerator cavity and keeping food fresher for longer. Generally, the fan can be kept on for between 3 and 10 minutes after the compressor is turned off, without harming the internal cooling, but keeping the food moist and fresh.

The present invention, in an embodiment illustrated in FIGS. 9, 9*a*, 10, 10*a*, 10*b*, 10*c*, 10*d*, 11 and 12, comprises steps of method 100 for, starting from a refrigerator door opening event and by means of a treatment of the measured and calculated temperature values, to detect if a thermal load was inserted or not during a door opening event. That is, detecting whether, for example, food or air has been inserted with a different thermal load than the inside of the refrigerator cabinet.

This embodiment comprises steps to classify measurements between a regular door opening event and a door opening event with food insertion. After detecting the thermal load, in response, there are additional steps performed on refrigerator actuators, however, all of them are not exhaustively described here, as each particular refrigerator embodiment has a different type of configuration (motor fan, manual damper, electronic damper, specific compressors, etc.). However, in some embodiments, according to method 100 of the present invention, a blast chill routine may be triggered by the heat load detection steps.

For example, if cyclic tests of a refrigerator were performed at 10° C., 20° C., 32° C. and 43° C., vector a) should be [10, 20, 32, 43], vector b) must be filled in according to the result of the cycle. If at 32° C. the average temperature was 3.5° C., the applied offset should be −0.5° C. Intermediate ambient temperature assessments can be made using a linear interpolation approach or similar techniques.

Figure 9A:
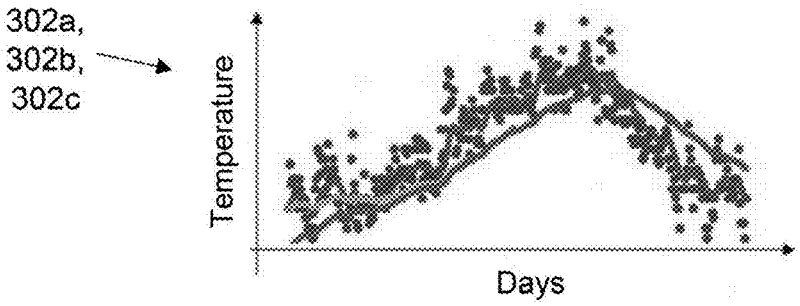
FIG. 9*a* illustrates an application of an exponentially weighted average in a set of classification steps of the present invention.

The method 100 of the invention, as illustrated in FIG. 9*a*, provides a preliminary exponentially weighted average step "EWA" in a set of classification steps, which represents a major contribution to obtaining an accurate result. This technique is mainly used to reduce the consideration of data from a time series composed of noise. It is also called "smoothing" the data. In this sense, the method 100 essentially weighs the number of observations and uses a definition of the mean of these.

The mentioned classification is made by an application of the support vector machine technique "SVM" for more accurate results. The fundamental idea behind SVM is best understood by the description below with reference to FIGS. 10*a* and 10*b* which show part of a data set, wherein two classes can be easily separated by a straight line (they are linearly separable).

Figure 10:
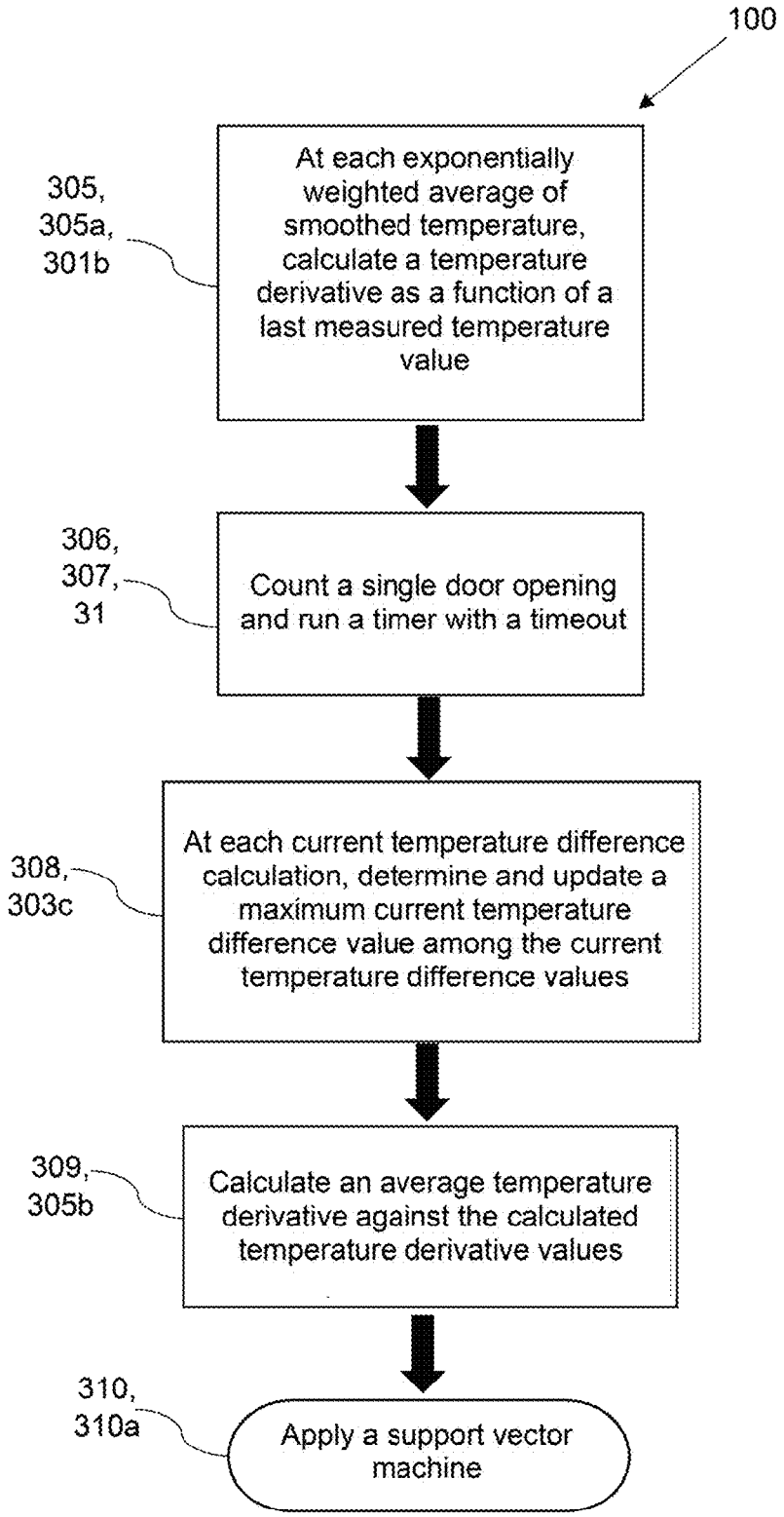
FIG. 10 is an illustration of the application of a support vector machine according to embodiments of the present invention.
Figure 10A:
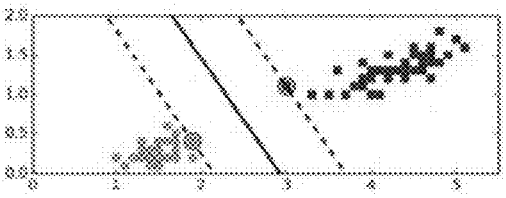
FIG. 10*a* shows the decision limits of three regularly possible linear classifiers.

The graph illustrated in FIG. 10*a* shows the decision limits of three possible linear classifiers. The model whose decision boundary is represented by the dashed line is not able to separate the classes properly. The other two models work perfectly in this training set, but their decision limits get so close to the instances that these models do not perform satisfactorily in new instances.

Figure 10B:
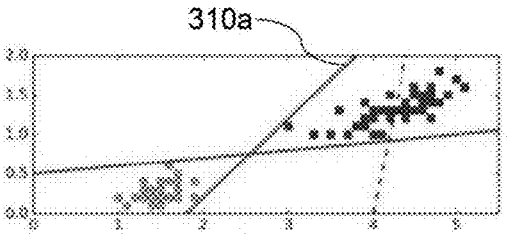
FIGS. 10*b* and 10*c* show the decision boundary between two classes (thermal loaded and unloaded) in accordance with an embodiment of the present invention.

In contrast, according to an embodiment of method 100 of the present invention, in FIG. 10*b* the solid central line in the graph represents the decision limit of an SVM classifier, wherein this line not only separates the two classes, but is positioned as far away from the nearest training instances as possible. Thus, it is clear that, although several linear classifiers can be used or understood by a person skilled in the art, the use of an SVM presents advantages not theoretically foreseen.

According to an embodiment of the present invention illustrated in FIG. 10, the method 100 comprises the initial step of: monitoring an internal temperature sensor 41 of the refrigerator 1 and reading 301 a value corresponding to the measured internal temperature 301 a.

From the measured internal temperature 301*a* and a smoothing factor 302*a* of an exponentially weighted average of smoothed temperature 302*b* EWA, the method comprises calculating 302 an exponentially weighted average of smoothed temperature 302*c* EWA defined in time S(t); calculating 303 an current temperature difference 303*a*, 303*b* between the measured internal temperature 301*a* and the exponentially weighted average of smoothed temperature 302*c* EWA defined at calculated time S(t); and determining 304 a value relative to a rate of heat exchange 304*a*, 304*b* inside a food storage cabinet 2 of refrigerator 1.

In this set of steps, in one embodiment, the calculation 302 of the exponentially weighted average of smoothed temperature 302*c* EWA defined at time S(t) comprises the equation:

$$S(t) = \text{Smoothing factor } (302a) \times \text{Measured internal temperature } (301a) + (1 - \text{Smoothing factor } (302a)) \times S\ (t-1)$$

Still, in one embodiment, the calculation 303 of the current temperature difference 303*a*, 303*b* between the measured internal temperature 301 a and the exponentially weighted average of smoothed temperature (302*c*) S(t) EWA calculated comprises the equation:

$$\text{Current temperature difference } (303a, 303b)\ (t) = \text{Measured internal temperature } (301\text{a})\ (t) - S\ (t)$$

Continuing the description referring to FIG. 10, the steps of the method 100 comprise, for a positive current temperature difference value 303*a*, determining 304 the value relative to the heat exchange rate 304*a* inside the food storage cabinet 2 of refrigerator 1 as above a value of heat exchange rate inside cabinet 2 before reading the internal temperature sensor 41 of refrigerator 1, setting a detection of heating inside cabinet 2.

Also, the steps of method 100 comprise, for a negative current temperature difference value 303*b*, determining 304 the value relative to the rate of heat exchange 304*b* within food storage cabinet 2 of refrigerator 1 as equal to or below of a heat exchange rate value inside cabinet 2 before reading the internal temperature sensor 41 of refrigerator 1.

According to an embodiment of the present invention, the method 100 as illustrated in FIG. 10, further comprises, at each calculation 302 of the exponentially weighted average of smoothed temperature (302*c*) S(t) EWA; calculating 305 a temperature derivative 305*a* as a function of the measured internal temperature value 301*a* defined by a last measured temperature value 301*b*.

For some embodiments of the present invention, as shown in FIG. 10, the steps of the method 100 comprise, monitoring the door opening sensor 31 and counting 306 a single door opening 3; and run 307 a timer with timeout after door opening 3.

Additionally, method 100 comprises, at each calculation 303 of the current temperature difference 303*a*, 303*b* between the measured internal temperature 301*a* and the exponentially weighted average of smoothed temperature 302*c* S(t) EWA, determining and updating 308 a maximum value of current temperature difference 303*c* among the current temperature difference values 303*a*, 303*b* calculated over time after door opening 3; and calculating 309 an average of temperature derivative 305*b* with respect to the calculated temperature derivative 305*a* values over time after door opening 3.

Figure 11:
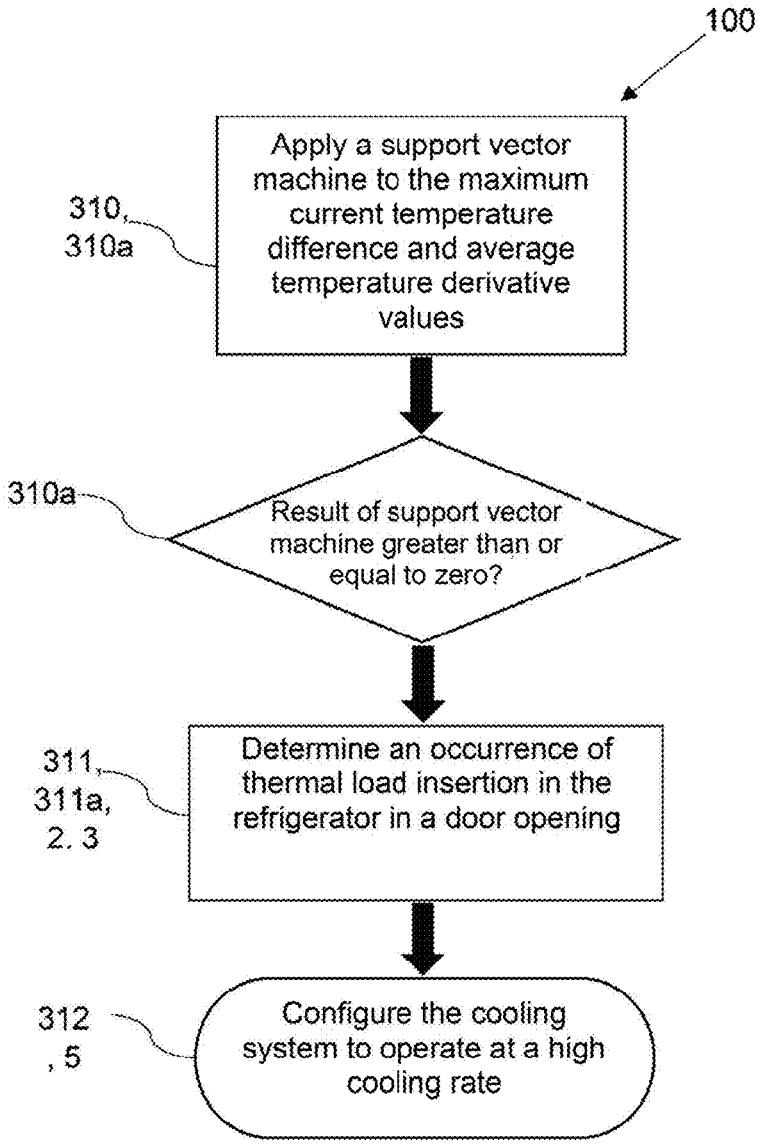
FIG. 11 of an embodiment of operating mode in a refrigerator, according to a support vector machine of the present invention.

FIG. 11 illustrates for some embodiments of the present invention, the steps of the method 100 that comprise: applying 310 the support vector machine technique 310*a* SVM to the values of maximum value of current temperature difference 303*c* and average of temperature derivative 305*b*.

In addition, in these embodiments the method 100 comprises, for a result of the support vector machine 310*a* SVM greater than or equal to zero, determining 311 an occurrence of a heat load insertion 311 a in the refrigerator 1 in a door opening 3.

For these embodiments, the output of the support vector machine 310*a* SVM comprises the equation:

$$\text{result} = \alpha \times \underset{\text{temperature difference (303c)}}{\text{maximum value of current}} + \beta \times \underset{\text{derivative (305b)}}{\text{average of temperature}} + \gamma, \quad (303c)$$

wherein:

α=constant of variation of temperatures in the refrigerator;

β=constant of average temperature in the refrigerator; and

γ=constant of refrigerator heat exchange.

That is, for different refrigerators, the multiplication values of the variables will be different and based on constants of temperature differences and heat exchange from refrigerator size, internal air flow, compressor power, cooling elements, among others, generally obtained through specific simulation of refrigerators or laboratory tests.

Figure 10C:
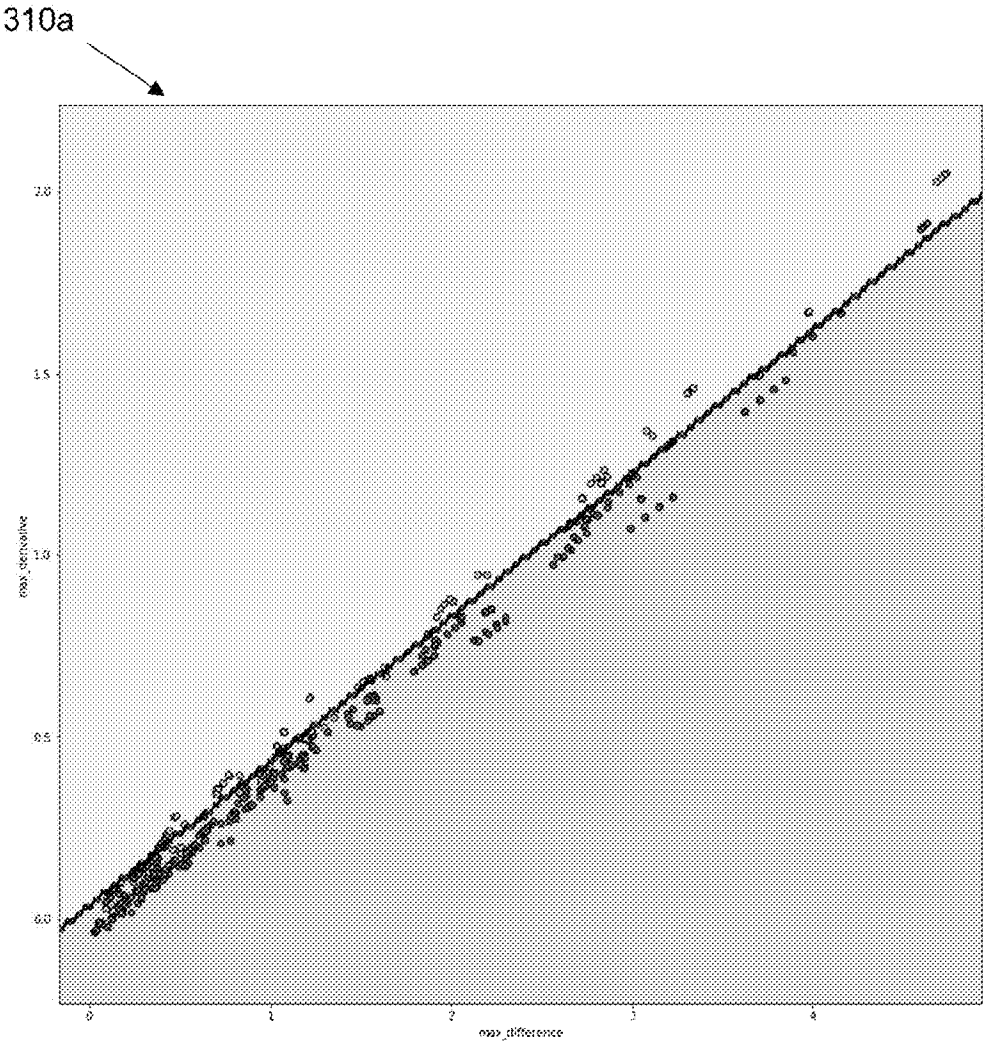

According to the method of the present invention in the set of steps of the support vector machine 310*a* SVM, a result greater than or equal to zero identifies a thermal load insertion 311 a, and a result of less than zero does not identify a thermal load insertion 311 a. FIG. 10*c* shows the decision limit between the two classes, determining a thermally loaded refrigerator and an unloaded one.

In an additional configuration, the support vector machine 310*a* SVM uses a more complex equation based on an intercept coefficient wherein the support vector machine 310*a* SVM intercepts the zero value on the axis, the multiplication coefficient of the ambient temperature of the 310*a* SVM support vector machine, the door opening time multiplication coefficient of the 310*a* SVM support vector machine, as well as the coefficient of returning time to the refrigerator set point, multiplied by the specific values (and respective) of the ambient temperature, open door time and time to return to the set point scaled by means of the variable value minus the minimum value of the variable, wherein the result is divided by the maximum value of the variable minus the minimum value of the variable, or that is, following the equation below:

$$\text{result} = CoefIntercept + CoefAmbientTemperature \times AmbientTemperatureEsc + CoefTimeOpenDoor \times TimeOpenDoorEsc + CoefSet\ pointReturnTime \times \text{Set}\ pointReturnTimeEsc, \text{ wherein:}$$

$$\text{Variable } Esc = \frac{\text{Variable Value} - \text{Minimum Value of the Variable}}{\text{Maximum value of the Variable} - \text{Minimum Value of the Variable}}$$

When using an SVM with linear determination to separate the classes, with advantages already determined, the separation surface will be a straight line, a plane or a hyperplane depending on the number of variables, inputs, that are used in the model. So, for example, when working with two variables, the separation surface can be written as a straight line, of function (y=a*x+b), wherein b is the coefficient that intersects the axis. This coefficient is an output of the method that finds the best decision boundary, thus increasing the number of hits compensated for errors, thus determining the intercept coefficient at which the support vector machine 310*a* SVM intercepts the zero value on the axis.

Figure 10D:
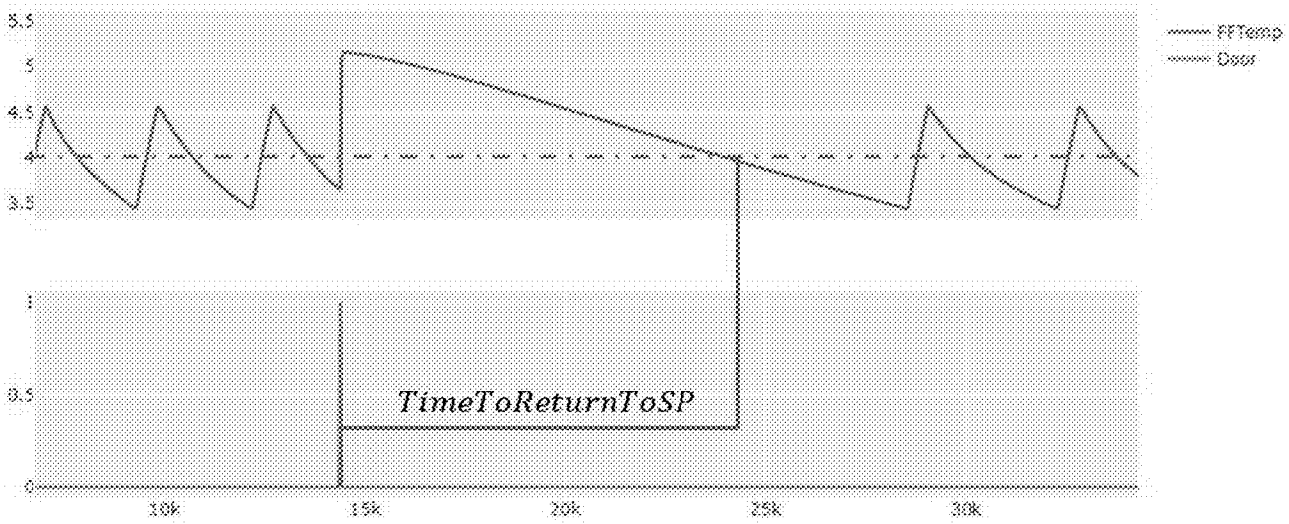
FIG. 10*d* illustrates a graph with internal temperatures of a refrigerator, in addition to determining the time to returning to the programmed temperature, or set point.

FIG. 10*d*, in turn, exemplifies the use of the set point return time, in which when defining a long return time, the control modifies the operation of the cooling system to keep it on for longer than that normally used by the cooling system, for example.

To obtain the parameters necessary to fit this model in a refrigerator 1, it is suitable to carry out a set of simulations using machine learning tools, changing the simulation parameters to cover a large number of thermal loading procedures in the refrigerator, to be incorporated into the support vector machine technique 310*a* SVM. In this case, the ambient temperature, the refrigerator set point, the moment the door was opened, how long the door was open and the initial thermal load inside the refrigerator before the door was opened were changed in the simulations for system learning.

These simulations consist of at least two different conditions. One with the presence of a thermal load in the refrigerator, in which, in this configuration for foods previously inserted, every time the ambient temperature changes and the moment the door is opened changes, a new configuration of final decision to determine the load is made.

The other of the two different simulation conditions was made, for example, without considering any previous thermal load inside the refrigerator. This means that the simulation is carried out with the insertion of a thermal load in the refrigerator, in which, in this configuration for foods inserted later, for example, different volumes of food may be added for each certain volume of food previously present in the refrigerator.

This, when incorporated into the method 100 of the present invention, aims to evaluate different scenarios of thermal loading in a refrigerator door opening, at different ambient temperatures, considering different proportions of previous thermal load already present in the refrigerator and different durations of time that the door remained open. As mentioned, after testing the product with heat load insertion, the same evaluation is done without inserting food with heat load.

Next, as described for method 100 of the present invention, an SVM support vector machine is trained and tested to classify between a thermal load on the refrigerator on door opening or just a door opening without any thermal load. This embodiment works well on a small amount of data, without overfitting the current data and presents good generalization to different thermal loading scenarios. The present invention applies these embodiments in different refrigerators (with similar characteristics) without the need to carry out training for each data model.

Figure 12:
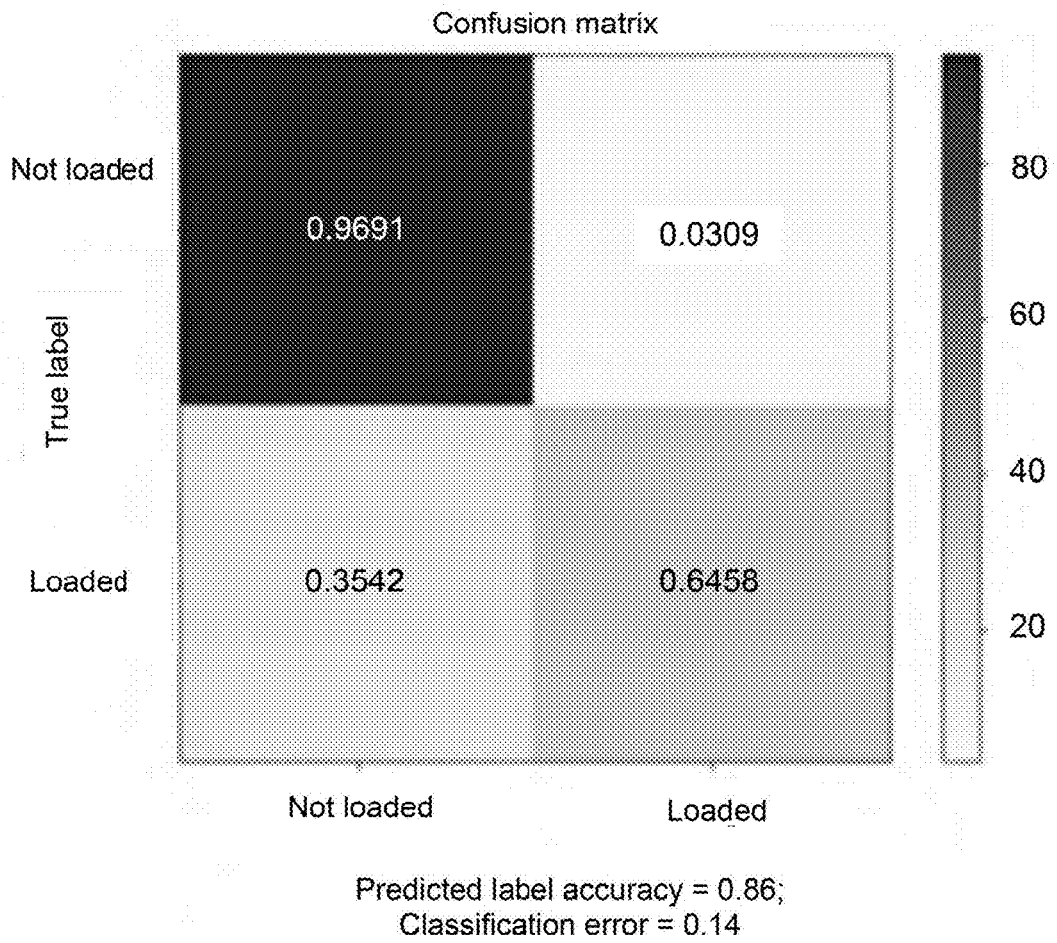
FIG. 12 illustrates results of a training phase for the application of a support vector machine according to the embodiments of the present invention.

FIG. 12 illustrates results of the training phase according to the embodiments of the present invention. In this example, the "loaded" class has a high precision and, when the method 100 detects a loading event, there is a high chance that it was indeed a thermal loading event in the refrigerator, in addition to being possible to determine actuations in the refrigerator for proper operation in response to these events.

In an additional embodiment of the present invention, an indirect load sensing method may be employed. In this configuration, a regular door opening and a door opening with food placement is distinguished by a thermal inertial state that is added to the system. In this sense, both events will increase the temperature reading by the evaporator sensor, but the cooling time to decrease this necessary temperature is different in both scenarios. This means that the cooling system stays on longer to cool the system and returning to the expected state when a load is placed on the refrigerator.

So, the first step of the method is to perform a check on the door sensor. If the sensor considers that the refrigerator door has been opened, a counter or timer is started to assess the load placement inside the refrigerator. In this sense, this counter or timer can be compared to a predetermined value or system cooling pattern and, if the cooling system remains running for a time longer than this predetermined value, the presence of a load is indicated.

One way of carrying out this detection uses, for example, the evaporator temperature at the moment of opening the door, a flag that indicates if the door was opened before the timeout event occurred, the time that passed between two calculations and the current state of the compressor, on or off.

Initially, the current state of the compressor and the current temperature of the evaporator, respectively, can be used. The other auxiliary variables must be set to zero at this point. After this step, a first check is performed, comparing the last state of the compressor with the current one. If the compressor has been turned off in this period, the compressor on time calculations is performed. Otherwise, if the current state of the compressor is the same as the previous one, the derivative calculation must be done, according to the equation below:

$$\text{Derivative} = EvaporatorTemperature - EvaporatorLastTemperature$$

$$EvaporatorLastTemperature = EvaporatorTemperature$$

$$SecondDerivative = \text{Abs}(\text{Derivative} - \text{Derivative EvaporatorLastTemperature})$$

If the current value of the second derivative is greater than the last value calculated in the previous cycle and the last derivative of the evaporator is different than zero, it is an indication that the product has changed the status of the compressor, then the evaluation counter of load must be increased. If the load evaluation counter is already greater than zero, it means that the system has identified some disturbance in the temperature sensor, then the value of the second derivative must be compared to a limit. This limit is a predetermined lower limit used to separate small turbulences in the system from the current heat that will impact the system. If the value of the second derivative is greater than this limit, the load evaluation counter must also be incremented.

The completion of loading or non-loading is done by evaluating whether the counter is greater than the predetermined maximum occurrences parameter, or equal to zero, it is determined that there was no load addition, since there was a temperature increase and also a fast enough temperature drop, no heat transfer to new system loads. Otherwise, the algorithm must return that a load was added, indicating that the load was detected and thus modifying the functioning of the cooling system (5).

A third mode of detection of load insertion in the refrigerator can be described using the same SVM support vector machine approach already described, with some changes, being executed every time the compressor is turned off, evaluating all the compressor in a cycle that has just ended. In this method, the first input is the evaporator temperature before the compressor is started, and then the evaporator temperature once the compressor needs to be turned off, according to the thermostatic control of the system. The other inputs to the support vector machine are the current ambient temperature and the current compressor speed. Thus, the support vector machine can be used to make predictions at runtime, producing a model that will reflect the behavior of a particular refrigerator.

In this regard, in an embodiment of the present invention the method 100 further comprises, during the occurrence of a thermal load insertion 311 a in the refrigerator 1 in a door opening 3, configuring 312 the cooling system 5 to operate in a high cooling rate compared to a cooling rate of a period prior to door opening 3.

Finally, a method of automatic detection of the operating mode of the cooling system 5 for a refrigerator is also provided. In this case, the door sensor will also be used as an input to decide whether some different functions should be performed, such as parties, shopping or quick relaxation routines. The number of doors opening in a time window is then used to evaluate these different functions. If there are a large number of doors opening in a small window of time, the shopping mode, if applicable for that refrigerator, can be executed. If there are a large number of doors opening in a longer time interval, party mode can run.

Exemplifying the method mentioned above, if the door has been opened after a time greater than a predetermined value for mode detection, the load detection method is started. If the door has been opened before in a smaller time window, but has not yet reached the maximum number of doors opening that configure a party or shopping event, then you must increment the door opening time used in SVM in the algorithm load detection. For example, if in the first door event it was open for ten seconds and in the second event for twenty seconds, the new input to the SVM must be thirty seconds. If the number of times the door has been opened is greater than the shopping limit (intrinsically less than the party limit), then the shopping mode can be activated. If the shopping mode is already activated and the counter that adds up to the number of times the door continues to be incremented is greater than a predetermined value for counting party openings, then the shopping function can be turned off and the party function can be turned on. When the party or shopping function is activated, the load detection methods are not executed, as the cooling system 5 operating routine has already been modified.

Also, when party mode is enabled, a new timer can be triggered to check door activity. If no door opening is verified in a predetermined time, then the party mode can be stopped, returning to the shopping mode function, as the party mode is also intrinsically longer than the shopping mode.

As an example, the normal operating mode of the cooling system can be determined by turning the compressor on and off for certain periods or by controlling the compressor speed to control a temperature set point inside the refrigerator, in addition to control fans and/or blowers to create an internal airflow to the refrigerator, while party mode can modify the operation of the refrigerator system by lowering this set point or keeping the system running longer even after reaching the set point, in order to maintain the temperature of the refrigerator even with the need to cool additional loads, and the party mode can be used for an even longer time or the positioning of the set point at an even lower value than in the shopping mode, to maintain the refrigerator temperature even with successive doors opening.

Thus, the method of the present invention additionally provides a step of automatic detection of the operating mode of the cooling system 5, which comprises: counting the number of doors opening in a first time window and a second time window; if there is a predetermined minimum number of doors opening for the shopping function in the first time window, activate the shopping mode by modifying the operation of the cooling system (5) to operate in an increased cooling regime in relation to an regular cooling regime for a period of time; if there is a predetermined minimum number of doors opening for the party function in the second time window, activate the party mode by modifying the functioning of the cooling system (5) to operate in an increased cooling regime in relation to a regular cooling regime for a period of time longer than the shopping mode period of time; if there are no doors opening in the second time window, activate the vacation mode by modifying the operation of the cooling system (5) to operate in a lower cooling regime in relation to a regular cooling regime; otherwise determine (311) an occurrence of a thermal load insertion (311*a*) in the refrigerator (1) in a door opening (3). In such a step, the first time window can be between 3 and 10 minutes; the second time window is between 10 and 45 minutes; the predetermined minimum number of doors opening for the shopping function is between 5 and 15; the predetermined minimum number of doors opening for the party function is between 15 and 25; the predetermined period of time of the shopping function is between 30 and 90 minutes; the predetermined period of time of the party function is between 90 and 300 minutes; and the determination (311) of occurrence of a thermal load insertion (311*a*) in the refrigerator (1) in a door opening (3) is carried out as already defined above.

Refrigerators typically have a fresh food compartment, or section, in which food items such as fruits, vegetables and beverages are stored and a freezer compartment, or section, in which food items that are to be kept in a frozen condition are stored. Refrigerators are provided with cooling systems that keep the food compartments fresh at temperatures slightly higher than or above zero degrees centigrade and the freezer compartments at temperatures below zero degrees centigrade.

Also, refrigerators generally have internal cabinet temperature sensors, external cabinet temperature sensors, door opening sensors, a heating element configured for defrosting the refrigerator and an electronic controller associated with these to control all the operations of the refrigerator.

The embodiments of the present invention, generally schematized in FIG. 13, are comprised of a refrigerator 1, with at least one food storage cabinet 2 that determines a cooling and/or freezing area; an isolation door 3 that opens and closes the refrigeration and/or freezing area of cabinet 2 for isolating the cabinet from the outside environment; a door opening sensor 31; an internal temperature sensor 41 of the refrigerator storage cabinet, an external ambient temperature sensor 42 of the refrigerator; a cooling system 5 configured so as to modify the temperature of the refrigeration and/or freezing area; a heating element 6 configured to defrost the refrigerator 1; an operating mode activation element 7; and at least one controller 8 configured to receive readings from at least sensors 31, 41, 42 and operating mode activation element 7 and configured to act at least on cooling system 5 and/or heating element 6; controller 8 being configured to perform a refrigerator control method 1.

This description presents examples to describe the invention, including the best way to enable anyone skilled in the art to carry out the invention, including creating and using any devices or systems and carrying out any incorporated methods. The scope of the invention is defined by the claims and may include other covered examples if they include steps and structural elements that do not differ from the literal language of the claims or if they include equivalent structural elements

The invention claimed is:

1. METHOD (100) FOR CONTROLLING REFRIGERATOR OPERATION (1), the refrigerator comprising:

a cabinet (2) that determines a refrigeration and/or freezing area;

an isolating door (3) that opens and closes the refrigeration and/or freezing area of the cabinet (2);

a door opening sensor (31); and a cooling system (5) configured so as to modify a temperature of the refrigeration and/or freezing area in order to decrease energy consumption and reduce noise;

the method (100) characterized by the fact that it comprises the steps of:

monitoring the opening and closing of the door (3) by means of the door opening sensor (31) during a determined period;

generating (206) a door opening probability distribution (206*a*) at the time monitored during the determined period; and maintaining or modifying the operation of the cooling system (5) according to a door opening probability distribution (206*a*). calculating (302) a weighted average of smoothed temperature (302*c*);

calculating (303) a current temperature difference (303*a*, 303*b*) between an internal temperature (301*a*) and a weighted average of smoothed temperature (302*c*);

determining and updating (308) a maximum value of current temperature difference (303*c*) after a single door opening;

calculating (309) an average temperature derivative (305*b*);

applying (310) a support vector machine (310*a*) SVM to the maximum value of current temperature difference (303*c*) and the average temperature derivative (305*b*);

when the support vector machine SVM (310*a*) result is greater than or equal to zero, determining (311) an occurrence of a thermal load insertion (311*a*) in the refrigerator; and when there is the thermal load insertion (311*a*), configuring (312) the cooling system (5) to operate in a high cooling regime in relation to a cooling regime in a period prior to the door opening (3).

2. METHOD (100), according to claim 1, characterized by the fact that the monitoring step comprises:

counting (203) a number of doors opening in the period of 1 hour in a door opening counter (203*a*) for each hour of a day;

continuously storing (204) a number of doors opening counted throughout the day in a local vector (204*a*) with relative positions respectively to each period of 1 hour of the day;

continuously counting and storing (205) moving average numbers of door opening events in a global vector (205*a*) with relative positions respectively to each period of 1 hour of the days.

3. METHOD (100), according to claim 2, characterized by the fact that the generating step comprises:

generating (206) a door opening probability distribution vector (206*a*) corresponding to the moving average numbers of door opening events of the global vector (205*a*) with relative positions respectively to each period of 1 hour of the days.

4. METHOD (100), according to claim 3, characterized by the fact that the accounting (205) of the moving average of door opening events in a global vector (205*a*) from a smoothing factor (205*b*) generates a result comprising an exponentially weighted average by the equation:

$$\text{Global vector (205}a\text{)} = \text{Smoothing factor (205}b\text{)} \times \text{Global vector (205}a\text{)} + (1 - \text{Smoothing factor (205}b\text{)}) \times \text{Local vector (204}a\text{)}$$

$$\text{Global vector (205}a\text{)} = \text{Smoothing factor (205}b\text{)} \times \text{Global vector (205}a\text{)} + (1 - \text{Smoothing factor (205}b\text{)}) \times \text{Local vector (204}a\text{)},$$

wherein the smoothing factor (205*b*) varies between 0 and 1.

5. METHOD (100), according to claim 1, characterized by the fact that it comprises the step of:

determining (304) a value relative to a heat exchange rate (304*a*, 304*b*) inside a cabinet (2) of the refrigerator (1).

6. METHOD (100), according to claim 5, characterized by the fact that it additionally comprises:

calculating (309) an average of temperature derivative (305*b*) with respect to the temperature derivative values (305*a*) calculated over time after the opening of the door (3).

7. METHOD (100), according to claim 1, characterized by the fact that the result of the support vector machine (310*a*) comprises the equation:

$$\text{result} = \alpha \times \text{maximum value of current temperature difference (303}c\text{)} + \beta \times \text{average of temperature derivative (305}b\text{)} + \gamma,$$

wherein a result greater than or equal to 0 identifies a thermal load insertion (311*a*), and a result of less than 0 does not identify a thermal load insertion (311*a*).

8. METHOD (100), according to claim 1, characterized by the fact that when the moving average and door opening probability stored in the global vector (205*a*) at a given start time (207*a*) increases in a next first hour (207*b*), but decreases in an adjacent next second hour (207*c*):

generating (207) a corrected door opening probability distribution vector (206*b*), by substituting the moving average number and door opening probability for the first hour (207*b*) as constant and equal to the moving average and door opening probability of the given start time (207*a*).

9. METHOD (100), according to claim 1, characterized by the fact that it additionally comprises:

returning (210), continuously, at an index, an initial time of a decreasing door opening probability period and storing in a reduced door opening probability pattern start vector (210*a*) with a certain number of positions, relative to each starting time of the decreasing door opening probability of each one of a certain number of sampling days; and returning (211), in the index, a duration of a constant and reduced door opening probability period of hours in a reduced door opening probability pattern period duration vector (211*a*) corresponding to each start time of the decreasing door opening probability period of each of the sampling days, the returned index corresponding to at least one region (210*a*, 211*a*) in the door opening probability distribution vector (206*a*, 206*b*) that defines a period with a reduced door opening pattern (211*b*).

10. METHOD (100), according to claim 9, characterized by the fact that it comprises a predetermined maximum duration for the duration of the reduced door opening probability period of hours, in which case the duration of the reduced door opening probability period of hours is longer than the predetermined maximum duration, the method further comprises the steps of:

determining a period adjustment value by subtracting the maximum duration from the duration of the reduced door opening probability period of hours; and add the period adjustment value to the start time of the door opening probability period or subtract the maximum duration period adjustment value from the duration of the reduced door opening probability period of hours.

11. METHOD (100), according to claim 1, characterized by the fact that it additionally comprises:

reading (212) a number of occurrences of a given starting time number of the decreasing door opening probability period in the positions of the reduced door opening probability pattern start vector (210*a*) of each of the sampling days;

selecting (213) a starting time number of the decreasing door opening probability period with the highest number of occurrences; and generating (214) a starting time number of the most frequent decreasing door opening probability period (214*a*) over the sampling days, corresponding to the starting time number of the decreasing door opening probability period with the highest number of occurrences, the returned index being a corrected index corresponding to a period with a most frequent reduced door opening pattern (214*b*).

12. METHOD (100), according to claim 9, characterized by the reduced door opening probability pattern start vector (210*a*, 214*a*) comprises 14 positions, relative to each starting time of the decreasing door opening probability for each of the 14 sampling days.

13. METHOD (100), according to claim 9, characterized by additionally comprising:

during the period with a reduced door opening pattern (211*b*, 214*b*), configuring (215) the cooling system (5) to operate in a reduced cooling regime in relation to a regular cooling regime of a regular doors opening period.

14. METHOD (100), according to claim 1, characterized by comprising the additional steps of:

defining a pre-programmed time limit (208*b*) for a defrost of the refrigerator (1) by a heating element (6); and defining a value from a time before (208*a*) to the pre-programmed time limit and a value from a time after (208*c*) to the pre-programmed time limit;

reading (208) a smallest of the moving average numbers of door opening events corresponding to each of the time before (208*a*) the pre-programmed time limit, the pre-programmed time limit (208*b*) and the time after (208*c*) to the pre-programmed time limit stored in the door opening probability distribution vector (206*a*, 206*b*) corresponding to the moving average numbers of door opening events of the global vector (205*a*) with 24 positions relative to each period of 1 hour of the days; and returning (209) a corrected reprogrammed time limit (209*d*) from the refrigerator (1) defrost start time, defined by one of the time before (208*a*) to the pre-programmed time limit, the pre-programmed time limit (208*b*) and the time after (208*c*) the pre-programmed time limit, which comprises the smallest of the moving average numbers of door opening events, and trigger the refrigerator defrost (1) according to the corrected reprogrammed time limit (209*d*).

15. METHOD (100), according to claim 1, characterized by comprising the additional steps of:

set a downtime evaluation time number;

monitoring the door opening sensor (31) and counting (215) a number of doors opening over the period defined by the downtime evaluation time number in the door opening counter (203*a*); and for a null returning on the number of doors opening over the period defined by the downtime evaluation time number of the door opening counter (203*a*) defining a period of inactivity, setting (216) a default operating temperature to a maximum operating temperature (216*a*) during the period of inactivity.

16. METHOD according to claim 1, characterized by comprising the steps of:

monitoring an external ambient temperature sensor (42) of the refrigerator (1) and reading (101) a value corresponding to the measured external ambient temperature (101*a*);

for an external ambient temperature value (101a) as it exceeds an ambient temperature rise limit value (101*b*) with respect to a reference ambient temperature of 25° C., calculating and storing (102) an operating temperature set point (102*a*) according to a temperature compensation value (102*b*, 102*c*) aggregated at a standard operating temperature defined by an average operating temperature (102*d*).

17. METHOD (100), according to claim 16, characterized by: the ambient temperature limit value (101*b*) is set between 1° C. and 10° C. with respect to a reference ambient temperature of 25° C., the temperature compensation value (102*b*, 102*c*) is set between 0.1° C. and 1° C., andthe standard operating temperature is defined by an average operating temperature (102*d*) defined between −4° C. and 10° C.

18. METHOD (100), according to claim 16, characterized by:

the ambient temperature limit value (101*b*) is set at 5° C. with respect to a reference ambient temperature of 25° C., the temperature compensation value (102*b*, 102*c*) is set to 0.5° C., and the standard operating temperature is defined by an average operating temperature (102*d*) set at 3° C.

19. METHOD (100), according to claim 16, characterized by additionally comprising:

for a temperature compensation value (102*b*) with positive module, configuring (103) the cooling system (5) to operate in a high cooling regime in relation to a cooling regime of a period prior to the reading of the external ambient temperature sensor (42) of the refrigerator (1); and for a temperature compensation value (102*c*) with negative module, configuring (103) the cooling system (5) to operate in a reduced cooling regime in relation to a cooling regime of a period prior to the reading of the external ambient temperature sensor (42) of the refrigerator (1).

20. METHOD (100), according to claim 5, characterized by the calculation (302) of an exponentially weighted average of smoothed temperature (302*c*) comprising the equation:

$$S(t) = \text{Smoothing factor } (302a) \times \text{Measured internal temperature } (301a) + (1 - \text{Smoothing factor } (302a) \times S(t-1).$$

21. METHOD (100), according to claim 5, characterized by the calculation (303) of the current temperature difference (303*a*, 303*b*) between the measured internal temperature (301*a*) and the exponentially weighted average of smoothed temperature (302*c*) calculated comprises the equation:

$$\text{current temperature difference}(303a, 303b)(t) = \text{Measured internal temperature } (301\text{a})\,(t) - S(t)$$

22. METHOD (100), according to claim 5 characterized by:

for a positive current temperature difference value (303*a*), determining (304) the value relative to the speed of heat exchange (304*a*) inside the cabinet (2) of the refrigerator (1) as above a value of the speed of heat exchange inside the cabinet (2) before the reading of the internal temperature sensor (41) of the refrigerator (1) which indicates that the cabinet is absorbing heat.

23. METHOD (100), according to claim 5, characterized by:

for a negative current temperature difference value (303*b*), determining (304) the value relative to the speed of heat exchange (304*b*) inside the cabinet (2) of the refrigerator (1) as equal to or below a value of the speed of heat exchange inside the cabinet (2) before the reading of the internal temperature sensor (41) of the refrigerator (1).

24. METHOD (100), according to claim 5, characterized by the calculation (302) of the exponentially weighted average of smoothed temperature (302*c*) comprising the equation:

$$S(t)=\text{Smoothing factor } (302a)\times\text{Measured internal temperature } (301a)+(1-\text{Smoothing factor } (302a))\times S(t-1).$$

25. METHOD (100), according to claim 7, characterized by the fact that it additionally comprises a step of automatic detection of the operating mode of the cooling system (5) comprising:

counting the number of doors opening in a first time window and a second time window;

if there is a predetermined minimum number of doors opening for a shopping function in the first time window, activating the shopping mode by modifying the operation of the cooling system (5) to operate in an increased cooling regime in relation to a regular cooling regime for a predetermined period of time from the shopping function;

if there is a predetermined minimum number of doors opening for a party function in the second time window, activating the party mode by modifying the functioning of the cooling system (5) to operate in an increased cooling regime in relation to a regular cooling regime for a predetermined period of time of the party function;

if there are no doors opening in the second time window, activating the vacation mode by modifying the operation of the cooling system (5) to operate in a lower cooling regime in relation to a regular cooling regime;

otherwise determining (311) an occurrence of a thermal load insertion (311a) in the refrigerator (1) in a door opening (3).

26. METHOD (100), according to claim 25, additionally comprising:

the first time window that is between 3 and 5 minutes;

the second time window that is between 5 and 45 minutes;

the predetermined minimum number of doors opening for the shopping function is between 8 and 14;

the predetermined minimum number of doors opening for the party function is between 15 and 25;

the predetermined period of time of the shopping function is between 30 and 90 minutes; and the predetermined period of time of the party function is between 90 and 300 minutes; and the determination (311) of occurrence of a thermal load insertion (311*a*) in the refrigerator (1) in a door opening (3) is carried out via the equation: result=α×maximum value of current temperature difference (303*c*)+β×average of temperature derivative (305*b*)+γ.

27. METHOD (100), FOR CONTROLLING REFRIGERATOR OPERATION (1), comprising:

a cabinet (2) that determines a refrigeration and/or freezing area;

an isolating door (3) that opens and closes the refrigeration and/or freezing area of the cabinet (2);

a door opening sensor (31);

a cooling system (5) configured so as to modify the temperature of the refrigeration and/or freezing area in order to decrease energy consumption and reduce noise;

the method (100) characterized by the fact that it comprises the steps of:

monitoring the opening and closing of the door (31) by means of the door opening sensor (31);

generating (206) a door opening probability distribution (206*a*) at the time of the monitoring; and maintaining or modifying the operation of the cooling system (5) according to a door opening probability distribution (206*a*).

calculating (302) a weighted average of smoothed temperature (302*c*);

calculating (303) a current temperature difference (303*a*, 303*b*) between an internal temperature (301*a*) and the weighted average of smoothed temperature (302*c*);

determining and updating (308) a maximum value of the current temperature difference (303*c*) after a single door opening;

calculating (309) an average temperature derivative (305*b*);

applying (310) a support vector machine (310*a*) SVM to the maximum value of the current temperature difference (303*c*) and the average temperature derivative (305*b*);

when the support vector machine SVM (310*a*) result is greater than or equal to zero, determining (311) an occurrence of a thermal load insertion (311*a*) in the refrigerator;

when there is the thermal load insertion (311*a*), configuring (312) the cooling system (5) to operate in a high cooling regime in relation to a cooling regime in a period prior to the door opening (3); and setting the standard operating temperature for a maximum operating temperature (216*a*) between 4° C. and 10° C.

28. METHOD (100), according to claim 27, characterized by additionally comprising:

during the period of inactivity, configuring (217) the cooling system (5) to operate in a reduced cooling regime in relation to a regular cooling regime of a regular doors opening period.

* * * * *